US010179964B2

(12) United States Patent
Kim et al.

(10) Patent No.: US 10,179,964 B2
(45) Date of Patent: Jan. 15, 2019

(54) LAUNDRY MACHINE

(71) Applicant: LG ELECTRONICS INC., Seoul (KR)

(72) Inventors: Sungryong Kim, Seoul (KR); Dongwon Kim, Seoul (KR); Kyeonghwan Kim, Seoul (KR); Heakyung Yoo, Seoul (KR); Youngmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 5 days.

(21) Appl. No.: 15/251,970

(22) Filed: Aug. 30, 2016

(65) Prior Publication Data

US 2016/0369443 A1 Dec. 22, 2016

Related U.S. Application Data

(62) Division of application No. 13/097,934, filed on Apr. 29, 2011.

(30) Foreign Application Priority Data

Apr. 30, 2010 (KR) ..... 10-2010-0040526
Apr. 30, 2010 (KR) ..... 10-2010-0040527
(Continued)

(51) Int. Cl.
*D06F 39/10* (2006.01)
*D06F 29/02* (2006.01)
(Continued)

(52) U.S. Cl.
CPC ..... *D06F 29/02* (2013.01); *D06F 29/00* (2013.01); *D06F 39/08* (2013.01); *D06F 39/085* (2013.01); *D06F 39/10* (2013.01); *D06F 39/12* (2013.01)

(58) Field of Classification Search
CPC ..... A47L 15/0084; A47L 15/4225; D06F 39/125; D06F 31/00; D06F 29/00
(Continued)

(56) References Cited

U.S. PATENT DOCUMENTS 4,030,788 A 6/1977 Bleeker ..... 312/333
5,470,142 A * 11/1995 Sargeant ..... A47L 15/0084 312/258
(Continued)

FOREIGN PATENT DOCUMENTS

CN 2260097 Y 8/1997
CN 1349012 A 5/2002
(Continued)

*Primary Examiner* — David G Cormier
*Assistant Examiner* — Thomas Bucci
(74) *Attorney, Agent, or Firm* — Dentons US LLP

(57) ABSTRACT

A laundry apparatus including a cabinet; a first space provided in the cabinet, in which a first treating part provided to treat laundry is installed; a second space provided in the cabinet, in which a second treating part provided to treat laundry is installed; a drawer movably provided in the second space, in which the second treating part is installed; and a rail unit configured to limit vertical and horizontal movement of the drawer with respect to the second space and to guide the outward movement of the drawer. Therefore, laundry may be treated by using the first and second treating parts and vibration and noise generated in the second treating part may be reduced.

12 Claims, 34 Drawing Sheets

(30) Foreign Application Priority Data

Apr. 30, 2010 (KR) ..... 10-2010-0040624
Apr. 30, 2010 (KR) ..... 10-2010-0040625
May 4, 2010 (KR) ..... 10-2010-00402004
May 28, 2010 (KR) ..... 10-2010-0050125

(51) Int. Cl.
*D06F 29/00* (2006.01)
*D06F 39/08* (2006.01)
*D06F 39/12* (2006.01)

(58) Field of Classification Search
USPC ..... 68/23.1, 27, 13 R, 17 R, 140, 208, 3 R, 68/23.3, 18 F, 196, 5 C; 134/56 D, 25.2, 134/200, 111, 18, 58 D, 104.2, 186, 110, 134/10, 104.1, 104.4
See application file for complete search history.

(56) References Cited

U.S. PATENT DOCUMENTS 5,660,063 A * 8/1997 Lee ..... D06F 39/10 210/167.01
6,167,733 B1 * 1/2001 Lee ..... D06F 39/085 68/18 F
7,472,712 B2 * 1/2009 Ashton ..... A47L 15/0084 134/104.1
8,028,548 B2 * 10/2011 Woo ..... D06F 39/10 68/12.13
2001/0010165 A1 8/2001 Kubota et al. ..... 68/12.12
2004/0148974 A1 * 8/2004 No ..... D06F 39/10 68/12.13
2004/0163690 A1 8/2004 Kim ..... 134/104.1
2005/0120758 A1 * 6/2005 Thies ..... D06F 39/10 68/18 R
2007/0240457 A1 * 10/2007 Jang ..... D06F 39/083 68/18 F
2007/0246089 A1 * 10/2007 Welch ..... A47L 15/0084 134/56 D
2008/0289368 A1 11/2008 Braz et al.
2009/0007602 A1 * 1/2009 Woo ..... D06F 39/10 68/208
2009/0113945 A1 * 5/2009 Kim ..... D06F 17/04 68/5 C
2009/0139273 A1 6/2009 Kim et al. ..... 68/23.1
2009/0139276 A1 * 6/2009 Kim ..... D06F 23/02 68/17 R
2009/0145174 A1 * 6/2009 Kim ..... D06F 23/02 68/27
2009/0145175 A1 * 6/2009 Kim ..... D06F 29/005 68/27
2009/0145176 A1 6/2009 Kim et al. ..... 68/27
2009/0158784 A1 * 6/2009 Kim ..... D06F 31/00 68/27
2009/0199601 A1 * 8/2009 Kim ..... D06F 39/083 68/208
2010/0064736 A1 * 3/2010 Jeong ..... D06F 29/00 68/13 R
2010/0088828 A1 * 4/2010 Kim ..... D06F 39/022 8/159
2010/0088829 A1 4/2010 Park et al. ..... 8/159
2010/0115709 A1 * 5/2010 Kim ..... D06F 39/022 8/159
2011/0016738 A1 1/2011 Ashrafzadeh et al. ..... 34/108
2011/0100071 A1 * 5/2011 Mazzon ..... D06F 39/10 68/208
2012/0138107 A1 * 6/2012 Fountain ..... A47L 15/0084 134/111
2013/0186437 A1 * 7/2013 Tuller ..... A47L 15/4251 134/99.1

FOREIGN PATENT DOCUMENTS

CN 2775090 Y 4/2006
CN 101451294 A 6/2009
DE 10-2008-058267 A1 6/2009
EP 2 063 012 A1 5/2009
EP 2 063 013 A1 5/2009
JP 10-211393 A 8/1998
JP 2000-334192 A 12/2000
JP 3443364 B 9/2003
JP 2004-089339 A 3/2004
JP 2007-120875 A 5/2007
KR 20-0136087 Y1 7/1995
KR 20-1998-0060623 U 11/1998
KR 10-0151205 B1 12/1998
KR 10-1999-0056859 A 7/1999
KR 10-2001-0088210 A 9/2001
KR 10-2003-0031343 A 4/2003
KR 10-0381163 B1 4/2003
KR 10-2003-0055973 A 7/2003
KR 10-2004-0046973 A 5/2004
KR 10-2006-0063394 A 6/2006
KR 10-2007-0034818 A 3/2007
KR 10-2007-0105054 A 10/2007
KR 10-2007-0113432 A 11/2007
KR 10-2008-0052964 A 6/2008
KR 10-2008-0065762 A 7/2008
KR 10-2008-0101380 A 11/2008
KR 10-2008-0109488 A 12/2008
KR 10-2009-0054787 A 1/2009
KR 10-2009-0027111 A 3/2009
KR 10-2009-0052457 A 5/2009
KR 10-2009-0057791 A 6/2009
KR 10-2009-0057792 A 6/2009
KR 10-2009-0078983 A 7/2009
KR 10-2010-0048343 A 5/2010

* cited by examiner

LAUNDRY MACHINE

CROSS REFERENCE TO RELATED APPLICATION

This is a Divisional Application of U.S. patent application Ser. No. 13/097,934 filed on Apr. 29, 2011, and claims the benefit of Korean Application Nos. 10-2010-0040526, 10-2010-0040625, 10-2010-0040624 and 10-2010-0040527, all filed on Apr. 30, 2010 and Korean Application Nos. 10-2010-0042004 filed on May 4, 2010 and 10-2010-0050125 filed on May 28, 2010, all of which are incorporated by reference in their entirety as if fully set forth herein.

BACKGROUND OF THE DISCLOSURE

Field of the Disclosure

Embodiments of the present invention relate to a laundry apparatus, more particularly, to a laundry apparatus including an auxiliary laundry device to treat clothes.

Discussion of the Related Art

In general, laundry apparatuses are electric appliances which can wash laundry by using both detergent and mechanical friction. Such laundry apparatuses can be used together with auxiliary devices for users to use them conveniently.

An auxiliary device may be provided beyond or below a washing apparatus and the auxiliary device provides a user with a variety of supplementary functions. However, the auxiliary devices are designed and manufactured as independent devices provided in the laundry apparatuses.

In the meanwhile, the laundry apparatus is directly installed in the floor. Especially, a front loading laundry apparatus has a laundry introduction opening located relatively low. Because of that, a user has an inconvenience when loading and unloading laundry into or out of the front loading laundry apparatus. To solve this inconvenience, a front loading laundry device has been proposed to include a stand provided there below.

Furthermore, various methods have been proposed to install an auxiliary laundry device in the stand, not simply using the stand as it is.

However, a lot of work may be required to use such a stand as an independent auxiliary device. Typically, the laundry apparatus having the auxiliary laundry device fails to have a good profile.

Compared with a main laundry device, the auxiliary laundry device utilizing the stand has various components configured to treat laundry which are installed in a relatively small space. Because of that, it is quite difficult to design and manufacture the auxiliary laundry device.

SUMMARY OF THE DISCLOSURE

Accordingly, embodiments of the present invention are directed to a laundry apparatus.

An object of an embodiment of the present invention is to provide a laundry apparatus including an auxiliary laundry device with an enhanced productivity and enhanced profile.

Another object of an embodiment of the present invention is to provide a laundry apparatus which can reduce vibration and noise, when the laundry apparatus includes an auxiliary laundry device.

A further object of further embodiments of the present invention is to provide a laundry apparatus which allows an inner configuration of an auxiliary laundry device to be installed efficiently, even if an inner space of the auxiliary laundry device is quite narrow.

Additional advantages, objects, and features of the disclosure will be set forth in part in the description which follows and in part will become apparent to those having ordinary skill in the art upon examination of the following.

To achieve these objects and other advantages in accordance with the purpose of the invention, as embodied and broadly described herein, a laundry apparatus includes a cabinet; a first space provided in the cabinet, the first space in which a first treating part provided to treat laundry is installed; a second space provided in the cabinet, the first space in which a second treating part provided to treat laundry is installed; a drawer movably provided in the second space, the drawer in which the second treating part is installed; and a rail unit configured to limit vertical and horizontal movement of the drawer with respect to the second space to guide the outward movement of the drawer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DETAILED DESCRIPTION

Exemplary embodiments of the present invention will be explained in reference to the accompanying drawings.

Reference will now be made in detail to the specific embodiments of the present invention, examples of which are illustrated in the accompanying drawings. Wherever possible, the same reference numbers will be used throughout the drawings to refer to the same or like parts.

Figure 1:
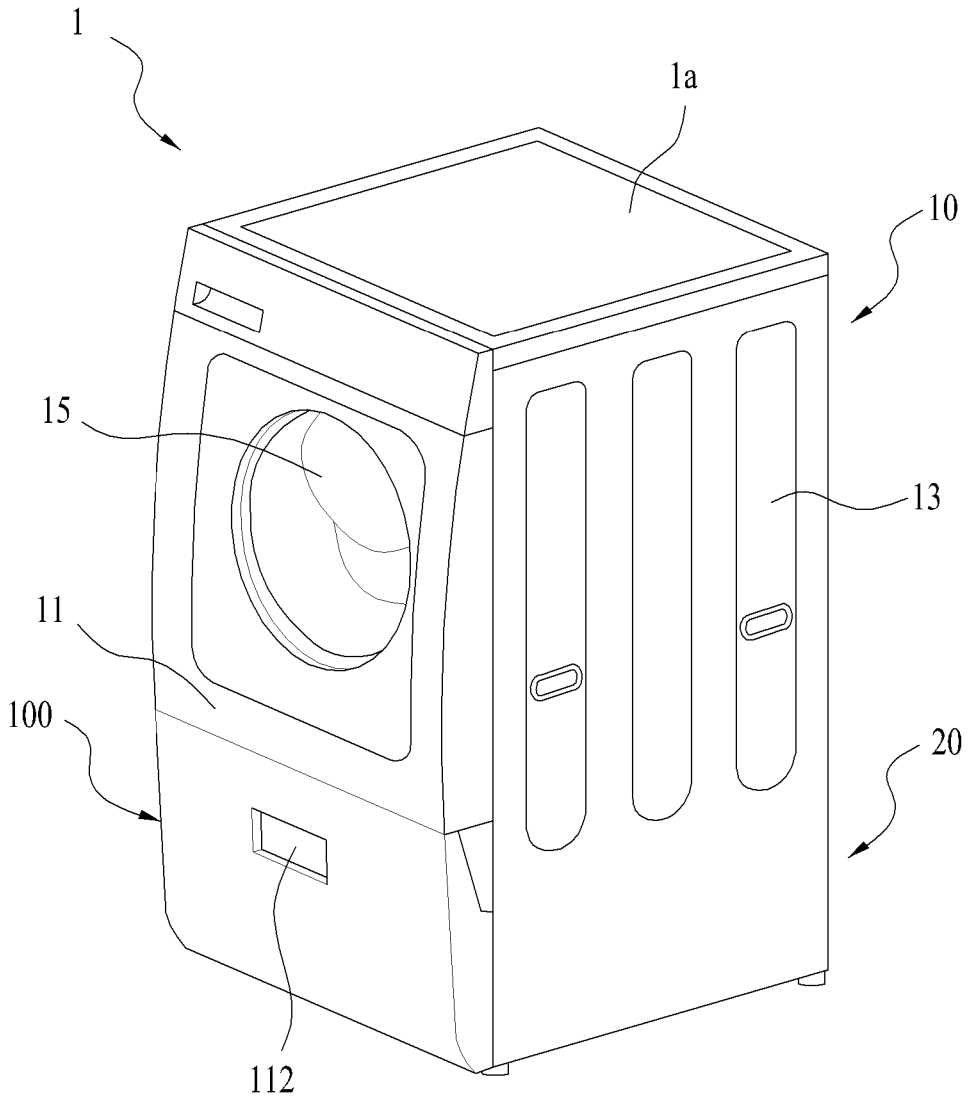
FIGS. 1 and 2 are perspective views illustrating a laundry apparatus according to an exemplary embodiment of the present invention.
Figure 2:
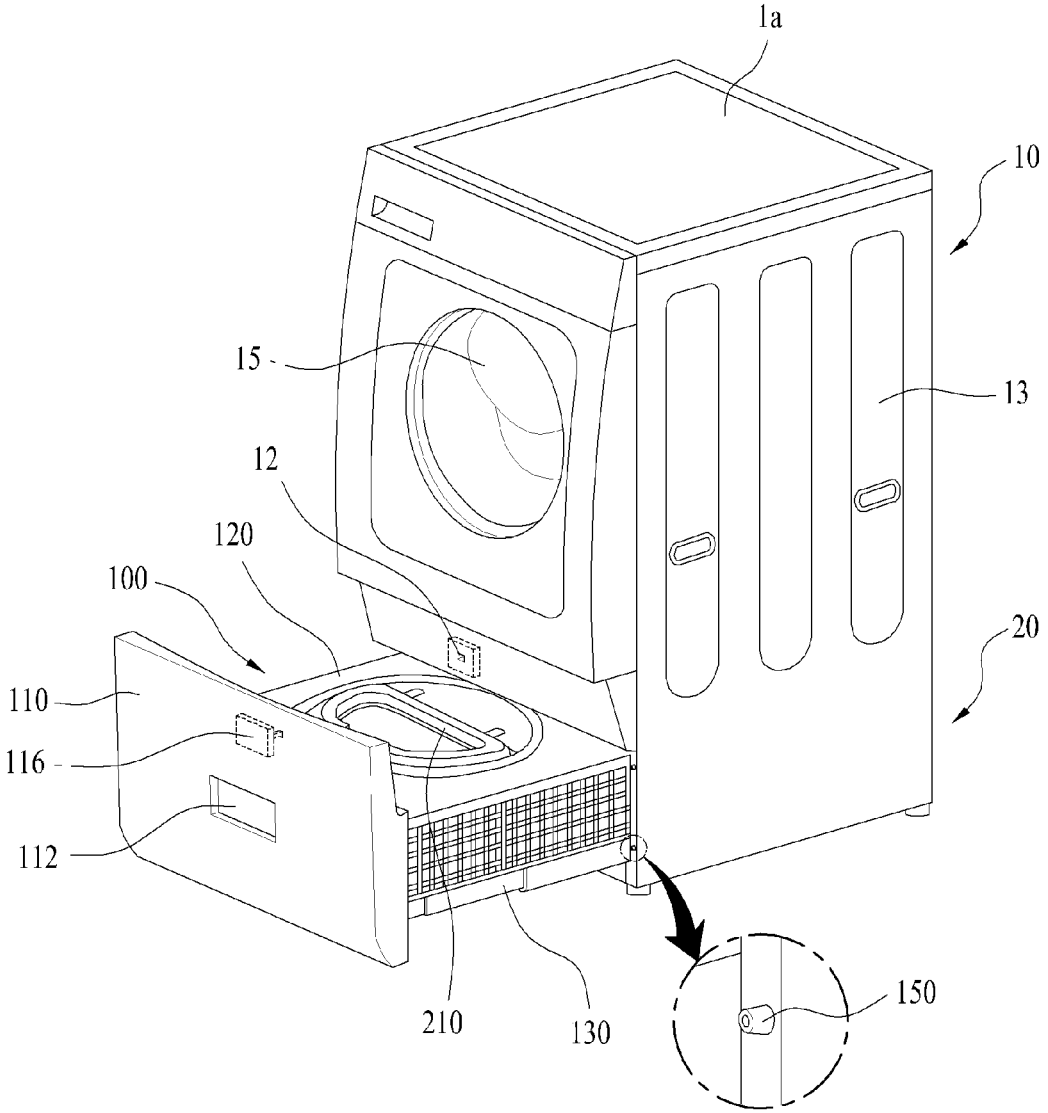

As shown in FIGS. 1 and 2, a laundry apparatus 1 includes a cabinet 1*a* configured to define a profile of the laundry apparatus 1. The cabinet 1*a* includes a first cabinet 10 where a first treating part 10*a* for treating laundry is formed and a second cabinet 20 where a second treating part 20*a* provided adjacent to the first cabinet 10 is formed to treat laundry.

In other words, a user loads laundry into the first cabinet 10 and/or the second cabinet 20 to perform washing, drying or refreshing. Here, the terminology 'refresh' may refer to a process of wrinkle removing, deodorizing, sanitizing, static electricity preventing or laundry warming, which uses air, heated air, steam, mist or water elements supplied to the laundry. In addition, clothes and laundry which will be mentioned in the present specification includes wearable objects including clothes, apparel, shoes, socks, gloves and hats and all kinds of washable objects having a washing process performed thereto.

In the meanwhile, the first treating part 10*a* may include a first tub (not shown) and/or a first drum (not shown) provided therein to wash laundry, that is, to perform washing, drying or refreshing with respect to the laundry, as mentioned above.

Figure 16:
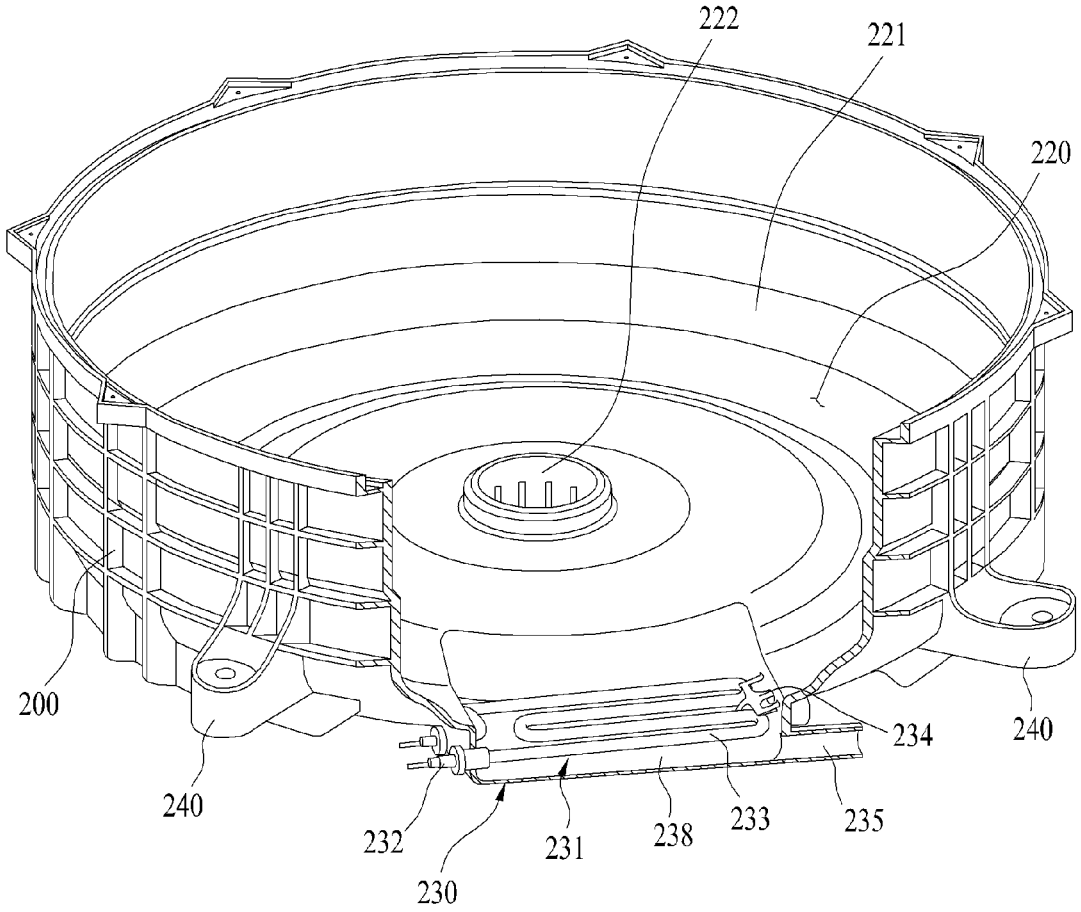
FIG. 16 is partially sectional view illustrating the second tub and the second drum of the laundry apparatus.

The second treating part 20*a* may include a second tub (200, see FIG. 16) configured to hold wash water therein and a second drum (600, see FIG. 16). The second treating part 20*a* may be provided adjacent to the first treating part 10*a* and it may be provided in a predetermined portion near the first treating part 10*a*. For example, the second treating part 20*a* may be provided below the first treating part 10*a*.

When the second treating part 20*a* is provided together with the first treating part 10*a* for washing the laundry, the first treating part 10*a* and the second treating part 20*a* may have the same washing capacity.

However, considering limitation of an installation space for the laundry apparatus 1 and production cost of the laundry apparatus 1, either of the first and second treating parts 10*a* and 20*a* may have a smaller capacity than the other one.

As shown in drawings, this embodiment illustrates that at least one of a washing capacity, a volume, or a height of the second treating part 20*a* may be smaller than at least one of a washing capacity, a volume or a height of the first treating part 10*a*. Because of that, the user may select one of the first and second treating parts 10*a* and 20*a* properly according to the amount of the laundry.

Moreover, the user may select the first treating part 10*a* or the second treating part 20*a* according to the types of laundry items. For example, sensitive laundry items such as infant clothes and lingerie which have to be separately washed or a small amount of laundry items may be washed by using the second treating part 20*a* and the other types of the laundry items may be washed in the first treating part 10*a*.

When the second treating part 20*a* is configured to have a smaller washing capacity than the first treating part 10*a*, the second treating part 20*a* may be provided below the first treating part 10*a*. Since the height of the first treating part 10*a* is increased by the second part 20*a* provided below the first treating part 10*a*, the user may load or unload the laundry into or out of the first treating part 10*a* more smoothly and more efficiently.

Moreover, when the laundry apparatus 1 includes the first treating part 10*a* and the second treating part 20*a*, the first cabinet 10, where the first treating part 10*a* is installed, and the second cabinet 20, where the second treating part 20*a* is installed, may be manufactured independently and connected with each other.

However, considering manufacture efficiency, in other embodiments the first cabinet 10, having the first treating part 10*a* installed therein, may be integrally formed with the second cabinet 20, having the second treating part 20*a* installed therein, to be a single cabinet 1*a*. In other words, a single cabinet 1*a* is shared and the first and second treating parts 10*a* and 20*a* may be provided in the single cabinet 1*a*. In this case, a partition wall (not shown) may be provided between the first treating part 10*a* and the second treating part 20*a* to separate them from each other.

Here, an internal space of the cabinet 1*a* may be partitioned off into the first and second cabinets 10 and 20 by the partition wall mentioned above. In some embodiments, the partition wall may include a predetermined opening (not shown) to allow the first treating part 10*a* and the second treating part 20*a* to communicate with each other.

In addition, configuration components provided in the second treating part 20*a* may be extended to an inside of the first treating part 10*a* via the opening. In other embodiments, configuration components provided in the first treating part 10*a* may be extended to an inside of the second treating part 20*a* via the opening.

As follows will be described an embodiment presenting that the first treating part 10*a* and the second treating part 20*a* are formed integrally as one body.

The first treating part 10*a* may include a first door which can be opened selectively. The user can open the first door 15 to load the laundry into the first treating part 10*a*.

A variety of components which will be described later may be provided in the second treating part 20*a*. However, the components may have a structure with an easy access for users' convenience, maintenance and the like.

For example, as shown in the drawings, the second treating part 20*a* may include a drawer 100 which can slide inward and outward. The drawer 100 is provided slidingly such that the user may draw the drawer 100 forward to have an access to the inside of the second treating part 20*a*.

As follows, the drawer of the second treating part according to the present invention will be described in detail in reference to the accompanying drawings.

Figure 3:
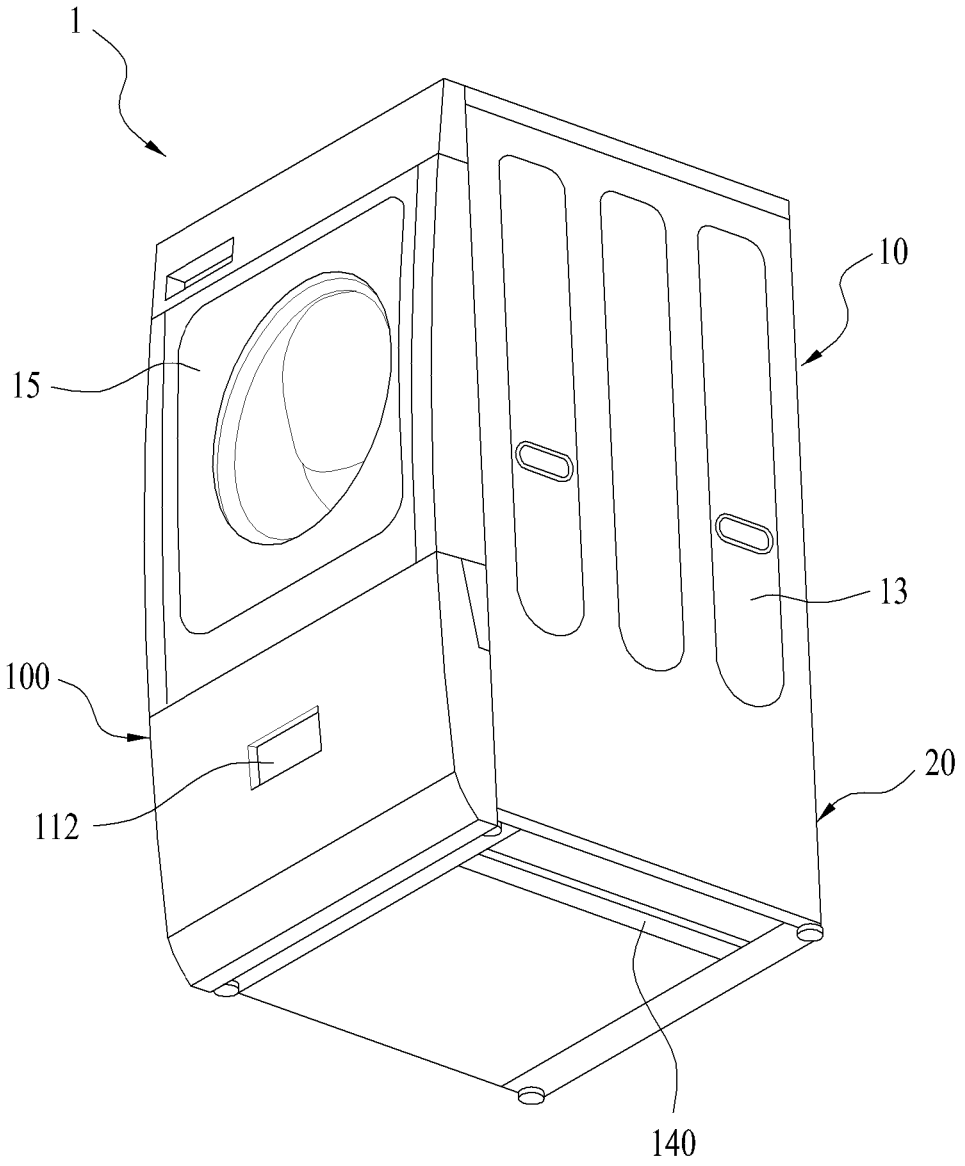
FIG. 3 is a perspective view illustrating a bottom surface of the laundry apparatus.

In reference to FIGS. 2 and 3, the drawer 100 may slide along an entry and exit space formed in the second cabinet 20 to open and close.

The laundry apparatus according to this embodiment includes a pair of side rail units 130 provided between the drawer 100 and the second cabinet 20 to guide the inward and outward movement of the drawer 100. Especially, the laundry apparatus includes a lower rail unit 140 provided underneath the drawer 100.

In the meanwhile, the side rail units 130 are provided between both side surfaces of the drawer 100. The second cabinet 20 may limit upward and downward motion of the drawer 100 and may guide the inward and outward motion of the drawer 100. The lower rail unit 140, provided between a bottom surface of the drawer 100 and the second cabinet 20, limits leftward and rightward motion of the drawer 100 and guides the inward and outward motion of the drawer 100.

Figure 4:
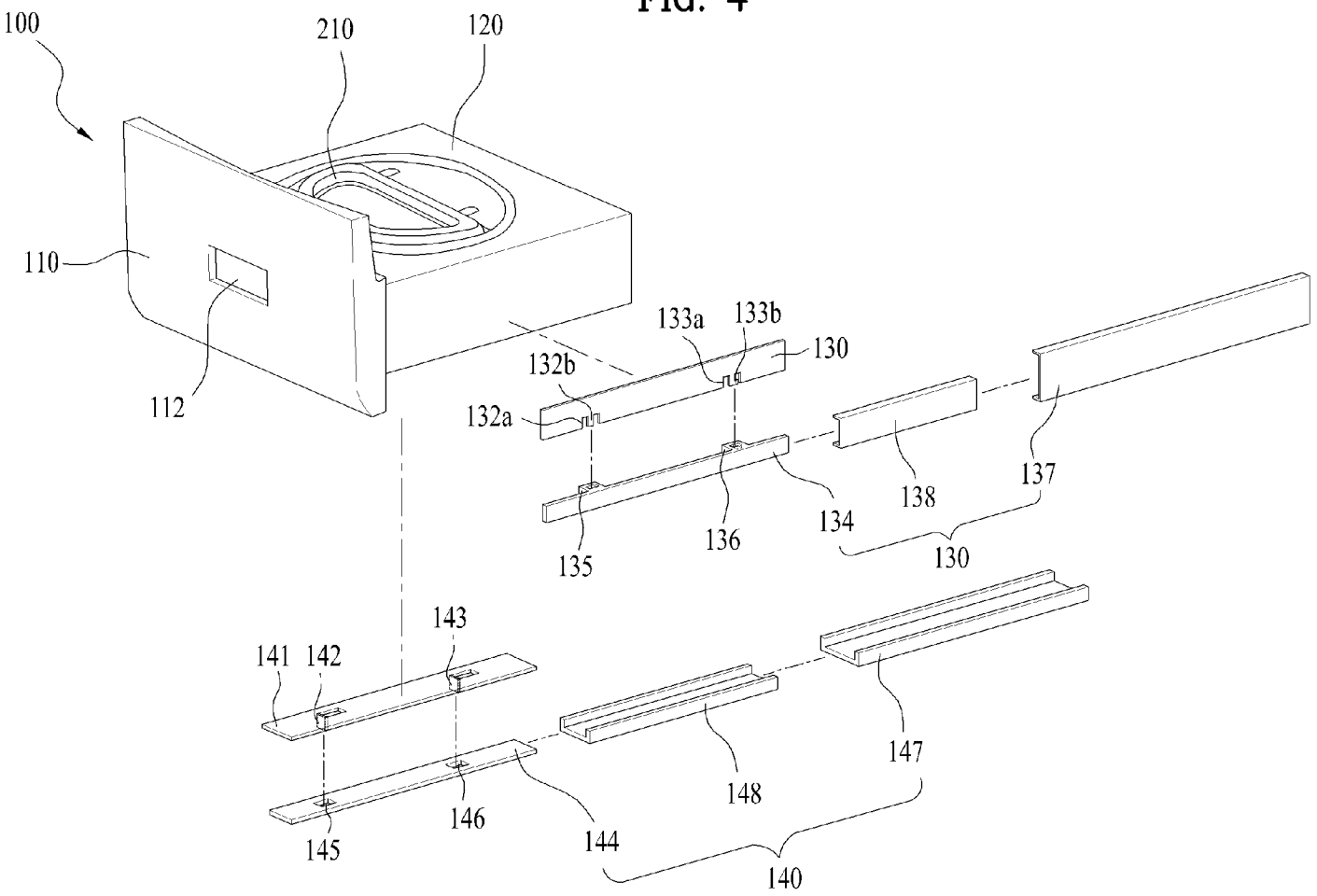
FIG. 4 is an exploded perspective view illustrating a drawer provided in the laundry apparatus.
Figure 5:
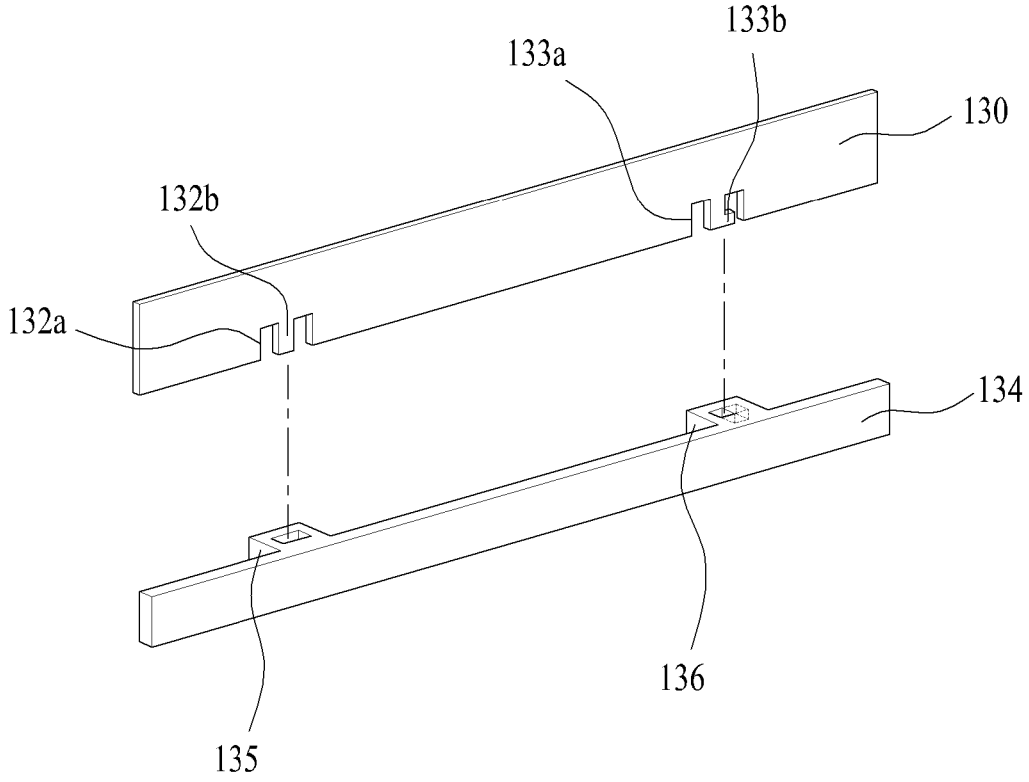
FIGS. 5 and 6 are perspective views illustrating a rail of the laundry apparatus.
Figure 6:
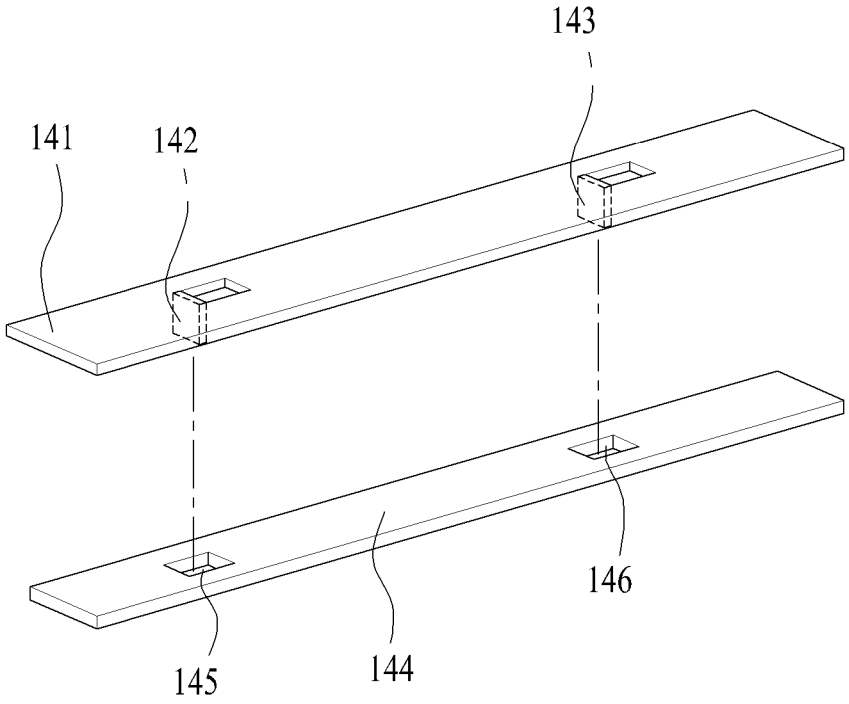

In reference to FIG. 4, the drawer 100 is configured of a front portion 110, forming a front surface of the drawer 100, and a housing 120 where the second treating part 20*a* will be installed. The front portion 110 is formed of a rectangular plate with a predetermined thickness and it is coupled to a front surface of the housing 120. A handle 112 is formed in a front surface of the front portion 110 to allow the user to grasp, when the user is moving to open and close the drawer 100.

As follows, the side rail units 130 installed between the housing 120 of the drawer 100 and the second cabinet 20 will be described in detail. Here, the side rail units 130 are symmetrically installed to both sides of the housing 120 in the same structure. Because of that, one of the rail units will be described first and description of the other rail unit will omitted.

Side brackets 131 are provided in both sides of the housing 120, to be coupled to the side rail units 130, respectively. The side bracket 131 is formed of a bar having a predetermined length and it includes a front recess 132*a* and a rear recess 133*a* formed therein.

A front hooking member 132*b* is formed in the front recess 132*a* and a rear hooking member 133*b* is formed in the rear recess 133*a*. The rear hooking member 133*b* is bent in an 'L' shape and the front hooking member 132*b* is formed straight.

The side rail unit 130 includes a moving rail 134 secured to the drawer 100, a fixed rail 137 secured to an inner surface of a side panel 13 provided in the second cabinet 20 and a middle rail 138 secured between the moving rail 134 and the fixed rail 137. A front coupling portion 135 and a rear coupling portion 136 are projected from a side of the moving rail 134. Recesses or holes are formed in the front and rear coupling portions 135 and 136 to insert the front and rear hooking members 132*b* and 133*b* therein. It is preferable that the rear coupling portion 136 is coupled to the rear hooking member 133*b* of the side bracket 132 and has a partially open top to prevent the inserted rear hooking member 133*b* from being separated.

The moving rail 134 of the side rail unit 130 is secured to the side bracket 131 provided on the side of the housing 120, the front hooking member 132*b* and the rear hooking member 133*b* of the side bracket 131 are inserted in the front and rear coupling portions 135 and 136 formed in the inner surface of the moving rail 134, such that the drawer 100 may be secured to the moving rail 134.

The fixed rail 137 of the side rail unit 130 is fixed to an inner surface of the side panel 13 provided in the second cabinet 20. The fixed rail 137 may be fixed to the side panel 13 by a bolt or a screw. A location where the fixed rail 137 is secured is corresponding to a location where the moving rail 134 is secured. Here, the middle rail 138 is secured between the fixed rail 137 and the moving rail 134.

The front hooking member 132*b* is projected from a front portion of a lower surface of the side bracket 131 and the rear hooking member 133*b* is projected from a rear portion thereof. A predetermined portion of the side bracket 131 may be cut out or bent to form the front and rear hooking members 132*b* and 133*b*.

In the meanwhile, the shapes of the front and rear hooking members 132*b* and 133*b* may be only an example and the present invention is not limited thereto. In other words, the front and rear hooking members 132*b* and 133*b* may be members used to secure the bracket to the moving rail and shapes of them may be varied properly.

A lower bracket 141 is provided in a bottom of the housing 120 to be secured to the lower rail unit 140. Compared with the side rail unit 130, the lower rail unit 140 has the same configuration, except a moving rail 144 having a different appearance. Front and rear coupling portions 145 and 146 are formed in an upper surface of the moving rail 144 to couple the lower bracket 141 thereto. The front and rear coupling portions 145 and 146 may be recesses or holes. The moving rail 144 of the lower rail unit 140 is secured to the lower bracket 141 provided in the bottom of the housing 120. Front and rear hooking members 142 and 143 formed in the lower bracket 141 are inserted in the front and rear coupling portions 145 and 146 formed in the moving rail 144, such that the drawer 100 may be secured to the moving rail 144.

A fixed rail 147 of the lower rail unit 140 is fixed to an inner surface of a base (not shown) composing the second cabinet 20. The fixed rail 147 may be fixed to the base by a bolt or a screw. A location where the fixed rail 147 is secured corresponds to a location where the moving rail 144 is secured. Together with that, a middle rail 148 is secured between the fixed rail 147 and the moving rail 144.

Typically, the second treating part 20*a* installed in the housing 120 is a top loading laundry device. The top loading laundry apparatus 100 includes a shaft 700 of a second drum 600 which is arranged perpendicular to the ground. When the second treating part 20*a* is put into operation, with the drawer 100 moved inwardly in the second cabinet 20, vibration would be generated in the second treating part 20*a* by the rotation of the second drum 600. Since the shaft 700 of the second drum 600 is arranged perpendicularly with respect to the ground, a lot of vibration might be generated in the drawer 100 including the second drum 600 in a direction parallel to the ground. Especially, this vibration is generated during a spinning cycle and more vibration is generated when the second drum 600 is eccentric.

When the side rail units 130 are secured to the drawer 100, the drawer 100 can move to a single degree of freedom along a forward and backward direction. In other words, vertical motion of the drawer 100 is limited by the securing of the moving rail 134, the middle rail 138 and the fixed rail 137 composing the side rail unit 130 and horizontal motion is also limited. However, the moving rail 134, the middle rail 138 and the fixed rail 137 composing the side rail unit 130 are secured to each other, spaced apart a predetermined distance from each other. Because of that, the drawer 100 can be moved along a leftward and rightward direction as much as the spaced distance and it might be vibrated in the leftward and rightward direction by the rotation of the second drum 600. The vibration is transferred to the laundry apparatus 1 including the first treating part 10*a*. As a result, durability of the laundry apparatus 1 will deteriorate and noise might be generated.

However, this embodiment of the present invention includes the lower rail unit 140, to limit the horizontal vibration of the drawer 100. In other words, the lower rail unit 140 not only guides the inner and outer motion of the drawer 100 but also limits the leftward and rightward vibration of the drawer 100. As a result, durability of the laundry apparatus 1 may be enhanced and noise may be reduced effectively.

The drawer 100 provided in the laundry apparatus according to this embodiment of the present invention may be completely separable from the second cabinet 20. In other words, when the second treating part 20*a* or the other parts located in the drawer 100 needs repairing, the drawer 100 can be detached from the second cabinet 20 to repair the second treating part 20*a* or the other parts smoothly and conveniently.

When the drawer 100 is detached, the drawer 100 is moved outward completely from the second cabinet 20. After that, the front portion of the drawer 100 is lifted a predetermined distance. At this time, the front hooking member 132*b* of the side bracket 131 is formed straight to be separated from the front coupling portion 135 of the moving rail 134 smoothly. However, the rear hooking member 133*b* is formed in the 'L' shape and it is not detached from the rear coupling portion 136, even the front portion 110 is lifted. The rear hooking member 133*b* may be sloping a predetermined angle along the direction in which the drawer 100 is lifted. At this time, when the drawer 100 is pulled along the sloping direction of the drawer 100, the rear hooking member 133*b* is detached from the rear coupling portion 136. Because of that, the drawer 100 is detached from the moving rail 134 to be completely detached from the second cabinet 20. Here, the front and rear hooking members 142 and 143 of the lower bracket 141 are formed straight. When the drawer 100 is lifted upwardly, the drawer 100 is detached from the moving rail 144 of the lower rail unit 140.

In the meanwhile, a locking assembly 116 and a locking securing part 12 are provided in the first cabinet 10 and the drawer 100 to limit the inner and outer motion of the drawer 100.

As shown in FIG. 2, the locking assembly 116 is provided in an upper portion of a rear surface of the front portion 110 to lock the drawer 100 when the drawer 100 is moved inwardly into the second cabinet 20 completely. Together with the locking assembly 116, the locking coupling portion 12 coupled to the locking assembly 116 is provided in a front panel 11 of the first cabinet 10. The locking coupling portion 12 is located opposite to the locking assembly 116.

The locking assembly 116 is coupled to the locking coupling part 12, to secure the drawer 100 not to move backward (that is, outward). The locking assembly 116 and the locking coupling portion 12 may be coupled to each other by hooking or any other suitable coupling method that is known to one of skill in the art.

When the drawer 100 is insertedly moved into the second cabinet 10 by the side rail units 130 and the lower rail unit 140, the side rail units 130 and the lower rail unit 140 reduce friction generated between the drawer 100 and the second cabinet 20. Because of that, when the drawer 100 is moved into the second cabinet 20, the drawer 100 may be easily accelerated by a little force applied thereto and it might collide with the second cabinet 20 by inertia.

This collision might apply a shock to the drawer 100 and the second treating part 20*a*, to damage to the components of the second treating part 20*a*. In addition, the shock might be transferred to the second cabinet 20, to damage the components of the first treating part 10*a*. As mentioned above, the shock generated in the drawer 100 and the second treating part happens to cause severe noise.

The laundry apparatus according to embodiments the present invention include a shock preventing part 150 to solve that problem. The shock preventing part 150 is employed to relieve the shock generated by the collision of the drawer 100 against the second cabinet 20, when the drawer 100 is moved into the second cabinet 20.

Figure 7:
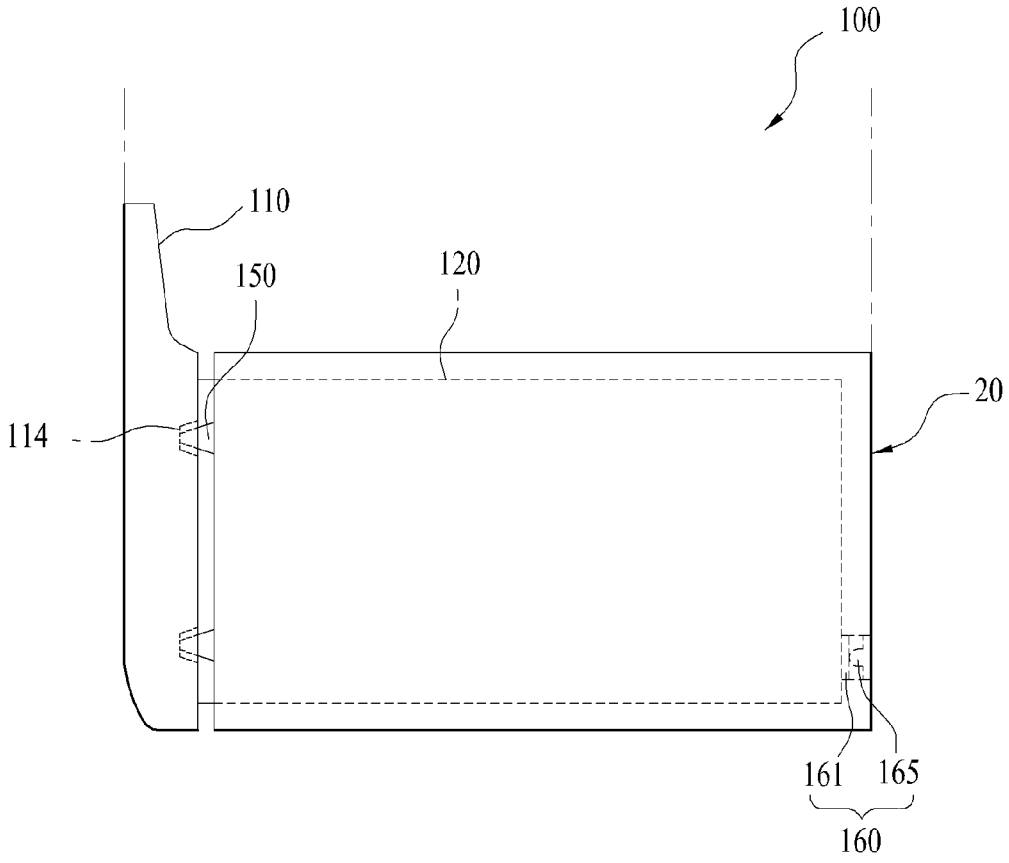
FIG. 7 is a side sectional view illustrating a second cabinet of the laundry apparatus.

In reference to FIGS. 2 and 7, the shock preventing part 150 is provided in the front of the cabinet 2 and it is formed in a trapezium shape, with a circular cross section. The shocking preventing part 150 may be any other suitable shape known to one of ordinary skill in the art. In some embodiments, two shock preventing parts 150 may be provided on both sides of the front portion of the second cabinet 20. In other embodiments, a total four shock preventing parts 150 may be attached or any other suitable number of shock preventing parts 150 known to one of skill in the art.

A bolt hole is formed in a center of the shock preventing part 150 and a bolt is inserted into the bolt hole to secure the shock preventing part 150 to the side of the front portion. It is preferable that the shock preventing part 150 is formed of an elastic material. In some embodiments, the shock preventing part 150 may be formed of rubber. In further embodiments, the shock preventing part 150 may be formed of an plastic or any other suitable elastic material known to one of skill in the art.

A receiving recess 114 is formed in the inner surface of the front portion 110 of the drawer 100 to receive the shock preventing part 150 therein. When the drawer 100 is moved into the second cabinet 20 completely, the front portion 110 of the drawer 100 may be designed to be spaced apart a predetermined distance from the side panel 13. The depth of the receiving recess 114 is smaller than the height of the shock preventing part 150 and it is preferable that the depth of the receiving groove 114 is a half to two thirds with respect to the height of the shock preventing part 150. Even if the shock preventing part 150 is pressed by collision with the drawer 100, the front portion 110 of the drawer 100 may not collide with the side panel 13.

Moreover, according to embodiments of the present invention, a rear lock 160 is further provided to secure the drawer 100 to prevent drawer 100 from sliding backwardly when moved into the second cabinet 20.

Figure 8:
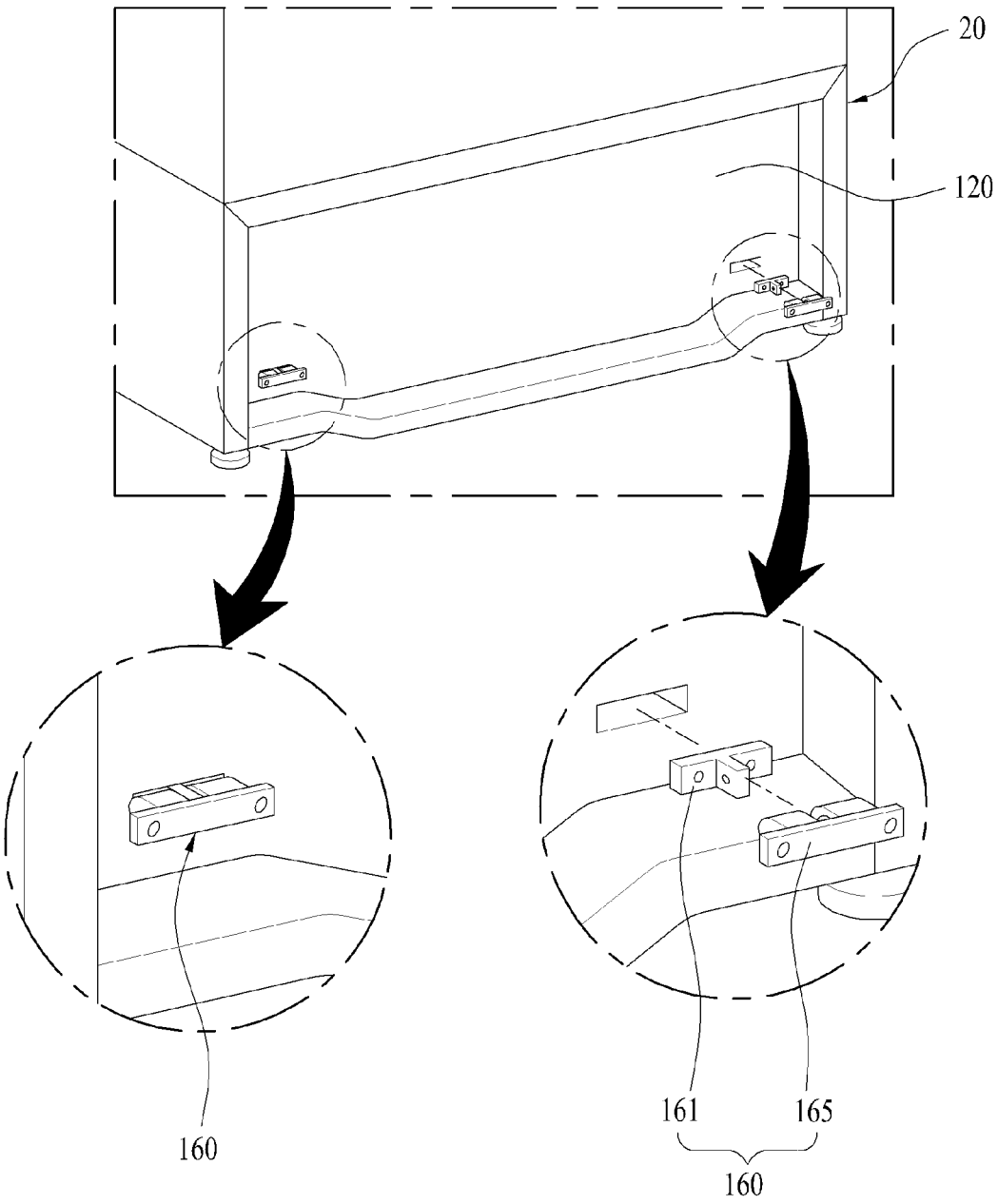
FIG. 8 is a perspective view illustrating an installation state of a rear lock provided in the laundry apparatus.
Figure 9:
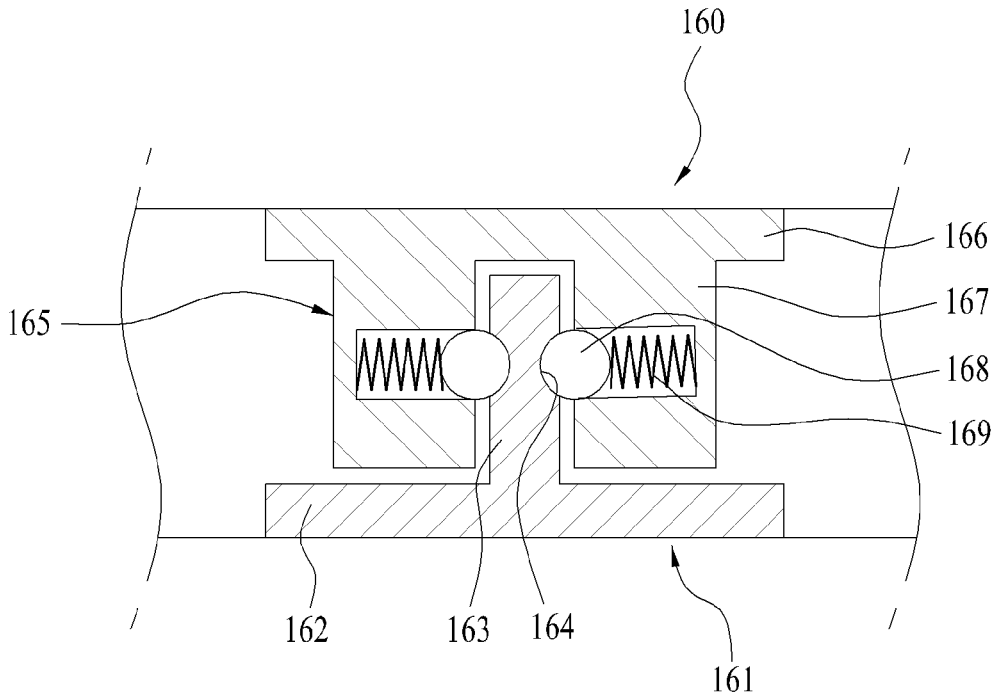
FIG. 9 is a sectional view illustrating the rear lock of the laundry apparatus.

In reference to FIGS. 7 to 9, the rear lock 160 is provided between a rear surface of the drawer 100 and a rear panel (not shown) of the second cabinet 20. The rear lock 160 includes an engaging part 161 engaging with the housing 120 of the drawer 100 and a clamp 165 installed in the rear panel of the second cabinet 20.

The engaging part 161 is configured of a support 162 having a bolt hole formed therein and a projection 163 coupled to the support 162. The engaging part 161 is fixed to a rear surface of the housing 120 by a bolt. A cross section of the projection 163 is rectangular and the projection 163 is formed in a center of the support 162. Arc-shaped engaging grooves 164 are formed in both sides of the projection 163.

The clamp 165 receives and secures the engaging part 161 thereto, and it is configured of two ball housings 167 spaced apart a predetermined distance from each other and a support 166 secured to lower portions of the ball housings 167. A bolt hole is formed in the support 166 and the clamp 165 is fixed to the rear panel by a bolt. A ball 168 is installed in the ball housing 167 and a hole is formed in the ball housing 167 to expose the ball 168 to the outside of the ball housing 167 partially there through. A diameter of the hole is smaller than a diameter of the ball 168 and a predetermined portion of the ball 168 is exposed via the hole. In addition, the ball 168 is supported by a spring 169 installed in the ball housing 167. An end of the spring 169 is secured to the ball 168 and the other end of the spring 169 is secured to an inner surface of the ball housing 167. The spring 169 is installed in a state of being compressed and the ball 168 is in close contact with the hole formed in the ball housing 167 by elasticity of the spring 169.

According to an operational principle of the rear lock 160, the projection 163 of the engaging part 161 is inserted between the ball housing 167 and the springs of the ball housing 167 are pressed accordingly. The elastic force which is strong in proportion to the pressed distances of the springs 169 is applied to the balls 168. As illustrated in FIG. 9, a plurality of springs 169 are located in a pair of ball housings 167 and apply the elastic force to the balls 168 toward the projection 163 and the plurality of balls 168 apply a predetermined force along a direction toward a center of the projection 163 from both sides of the projection 163. Because of that, the engaging part 161 is securely supported by the clamp 165. Together with that, the drawer 100 having the engaging part 161 secured thereto is secured to the second cabinet 20 having the clamp 165 secured thereto. Here, the plurality of balls 168 are inserted in the grooves 164 formed in the projections 163 and they do not slip along a side surface of the projection 163 accordingly.

When the drawer 100 is kept in the second cabinet 20, the drawer 100 may be secured between the locking assembly 116 provided in the front portion 110 of the drawer 100 and the locking securing part 12. However, when laundry is treated in the second treating part 20*a* installed in the drawer 100, the second drum 600 of the second treating part 20*a* rotates and vibration is generated accordingly. The vibration cannot be eliminated by the locking assembly 116 enough, resulting in vibration generated in the entire portion of the laundry apparatus.

The laundry apparatus 1 according to embodiments of the present invention may include the rear lock 160 provided in the drawer 100 to secure the drawer 100 stably and to restrain vibration. In addition, it is preferable that the rear lock 160 is installed in a rear portion of the rear surface of the drawer 100. Typically, the locking assembly 116 is arranged in the upper portion of the front portion 110 of the drawer 100. The rear lock 160 is installed in the lower portion of the rear surface of the drawer 100. The securing means of the drawer 100 may be arranged in symmetry in some embodiments. In other words, the locking assembly 116 and the rear lock 160 are arranged symmetrically, to secure the drawer 100 more stably.

As a result, the laundry apparatus according to embodiments of the present invention may include the rail provided in the bottom of the drawer to remove sideward-vibration generated when the auxiliary laundry device is put into operation. Because of that, durability of the laundry apparatus is enhanced and noise is effectively restrained.

Furthermore, the collision between the drawer and the cabinet which is generated by the inertia of the drawer motion when the drawer is moved into the cabinet may be prevented effectively.

Meanwhile, there may be several disadvantages when the drawer 100 is used to lead in and out the second treating part 20*a*. The second treating part 20*a* requires a water supply pipe to supply water to the second tub 200 and a drainage pipe to drain the wash water.

When the drawer 100 is led out, the second tub of the second treating part 20*a* is led out together with the drawer 100. At this time, the water supply pipe and the drainage pipe which are connected with the second tub 200 have to be extended. Therefore it may be necessary to provide a configuration used to extended or reduce the water supply pipe and the drainage pipe based on the leading-in and leading-out of the drawer 100. If the water supply pipe and the drainage pipe are not arranged effectively, the water supply pipe and the drainage pipe might be caught by the rear surface of the drawer 100 in the inward motion of the drawer 100. In addition, the water supply pipe and the drainage pipe might be torn or damaged by the drawer.

Because of the problem, the laundry apparatus 1 includes a water supply/drainage device 400 which is provided in a rear portion of the drawer 100 flexibly.

In reference to FIG. 10, the water supply/drainage device 400 includes a first link 420 and a second link 430 arranged below the first link 420. The first link 420 and the second link 430 are rotatably coupled to each other by a hinge. It is preferable that the first link 420 is provided beyond the second link 430.

Together with that, it is preferable that long axes of the first and second links 420 and 430 are arranged in parallel to a width direction of the second cabinet 20. In other words, the width of the second cabinet 20 having the drawer 100 provided therein is structurally longer than the height of the second cabinet 20. Because of that, the long axes of the first and second links 420 and 430 are arranged in parallel to the width direction of the second cabinet 20 and the first and second links 420 and 430 arranged vertically have an advantage in an aspect of space utilization.

The first link 420 and the second links 430 are symmetrical in a profile and a configuration. As follows, the same configuration elements of the second link 430 as those of the first link 420 will be omitted.

The first link 420 forms an internal space, with both open sides. A flexible water supply pipe 450 and a flexible drainage pipe 460 are insertedly installed in the both open sides of the first link 420. In other words, the flexible water supply pipe 450 and the flexible drainage pipe 460 are provided in the internal space of the first link 420.

An end of the first link 420 is connected to a rear panel (not shown) of the second cabinet 20 and the first link 420 is rotatably connected to the rear panel of the second cabinet 20. More specifically, the end of the first link 420 is hingedly connected with a first bracket 422 and the first bracket 422 is fixedly connected with the rear panel.

The second link 430 is connected with the lower portion of the first link 420. The profile and configuration of the second link 430 is identical to those of the first link 420, except an end of the second link 430 which is hingedly connected with the rear surface of the housing 120 provided in the drawer 100. More specifically, the end of the second link 430 is hingedly connected with a second bracket 432 and the second bracket 432 is fixedly connected with the rear surface of the housing 120. Together with that, the other end of the second link 430 is hingedly connected with the first link 420.

A hinge connecting part 470 is formed between the first link 420 and the second link 430 and a hinge shaft (not shown) is inserted in the hinge connecting part 470. The hinge connecting part 470 may be a projection. The hinge connection part 470 may be configured of a first projection 424 formed in a bottom of the first link 420 and a second projection 434 formed in a top of the second link 430. The first projection 424 and the second projection 434 may be integrally formed with the first link 420 and the second link 430, respectively.

A water supply hole 410 is provided in a rear upper portion of the second cabinet 20 and the water supply hole 410 is configured of a hot water supply hole 412 for supplying hot water and a cold water supply hole 414 for supply cold water. The water supply hole 410 is in communication with the flexible water supply pipe 450. The flexible water supply pipe 450 is branched to be two pipes. One of the branched pipes is connected with the hot water supply hole 412 and the other one is connected with the cold water supply hole 414. The flexible water supply pipe 450 is inserted in the first and second links 420 and 430. The flexible water supply pipe 450 may be arranged in "⊂" shape entirely. In other words, the flexible water supply pipe 450 may be inserted in the end of the first link 420 and exhausted from the other end. The flexible water supply pipe 450 exhausted from the other end of the first link 420 is inserted in an end of the second link 430 to be exhausted from the other end of the second link 430. The flexible water supply pipe 450 exhausted from the other end of the second link 430 may be connected with the second treating part 20*a*, passing through the rear surface of the housing 120.

The flexible drainage pipe 460 is installed in the same way as the flexible water supply pipe 450. In other words, the flexible drainage pipe 460 may be arranged in the first and second links 420 and 430 in a "⊂" shape. An end of the flexible drainage pipe 460 is exhausted to a rear portion of the second cabinet 20. In other words, a drainage portion of the flexible drainage pipe 460 configured to exhaust wash water outside is located in an outside of the second cabinet 20. It is preferable that a through hole (not shown) is formed in the rear panel of the second cabinet 20 to exhaust the flexible drainage pipe 460 there through.

It is preferable that the flexible water supply pipe 450 and the flexible drainage pipe 460 are formed of a flexible material which can be flexed according to the rotation of the first and second links 420 and 430.

Although not shown in the drawings, the first and second links 420 and 430 may guide a control line (not shown) and the control line includes an electricity line or a control line.

Moreover, it is described above that the end of the first link 420 located upper is connected with the rear panel and that the end of the second link 430 located lower is connected with the rear surface of the housing 120. Alternatively, the end of the first link 420 located upper is connected with the rear surface of the housing 120 and the end of the second link 430 located lower is connected with the rear panel.

As follows, an operational state of the water supply/drainage device 400 mentioned above will be described.

Figure 10:
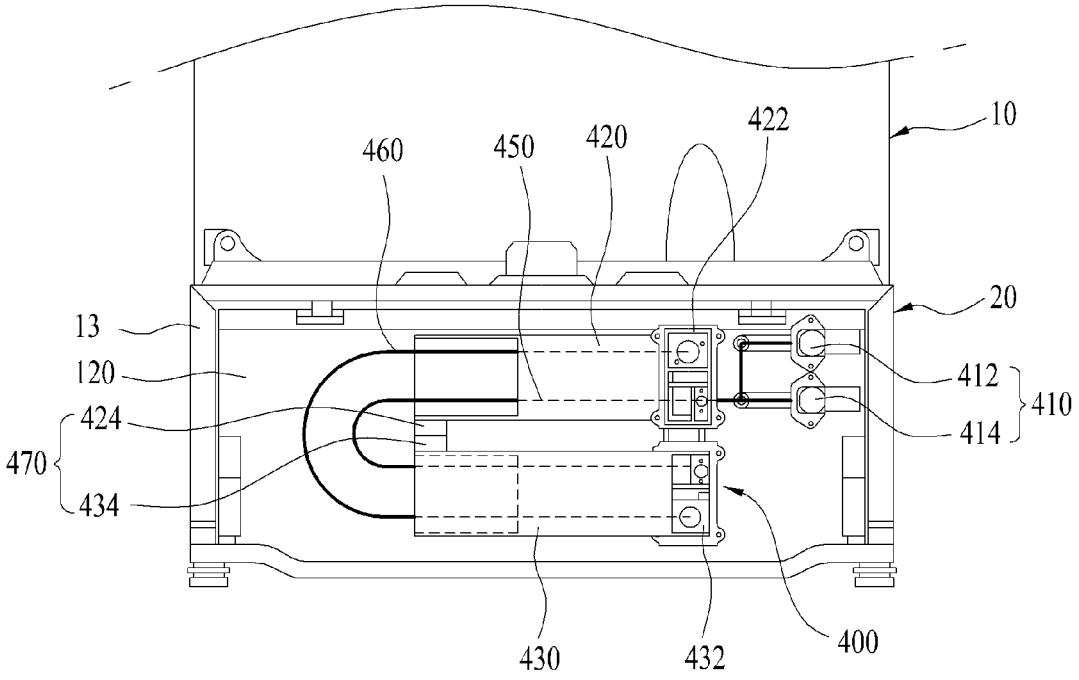
FIG. 10 is a rear view illustrating a water supply and drainage device of the laundry apparatus.
Figure 11:
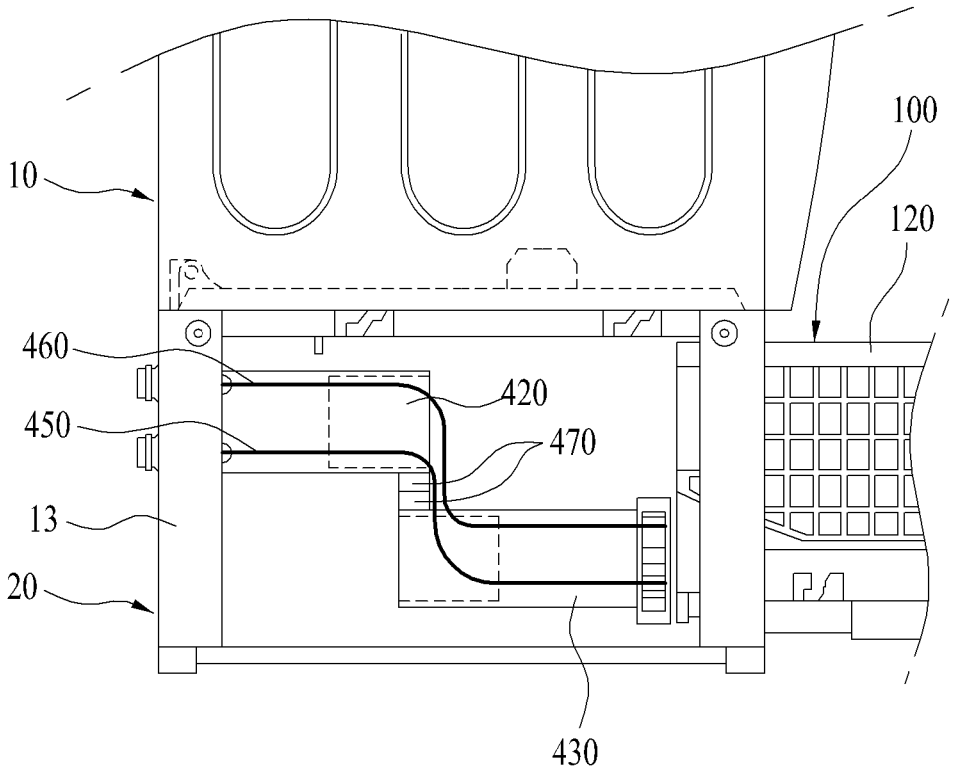
FIG. 11 is a side view illustrating the water supply and drainage device of the laundry apparatus.
Figure 12:
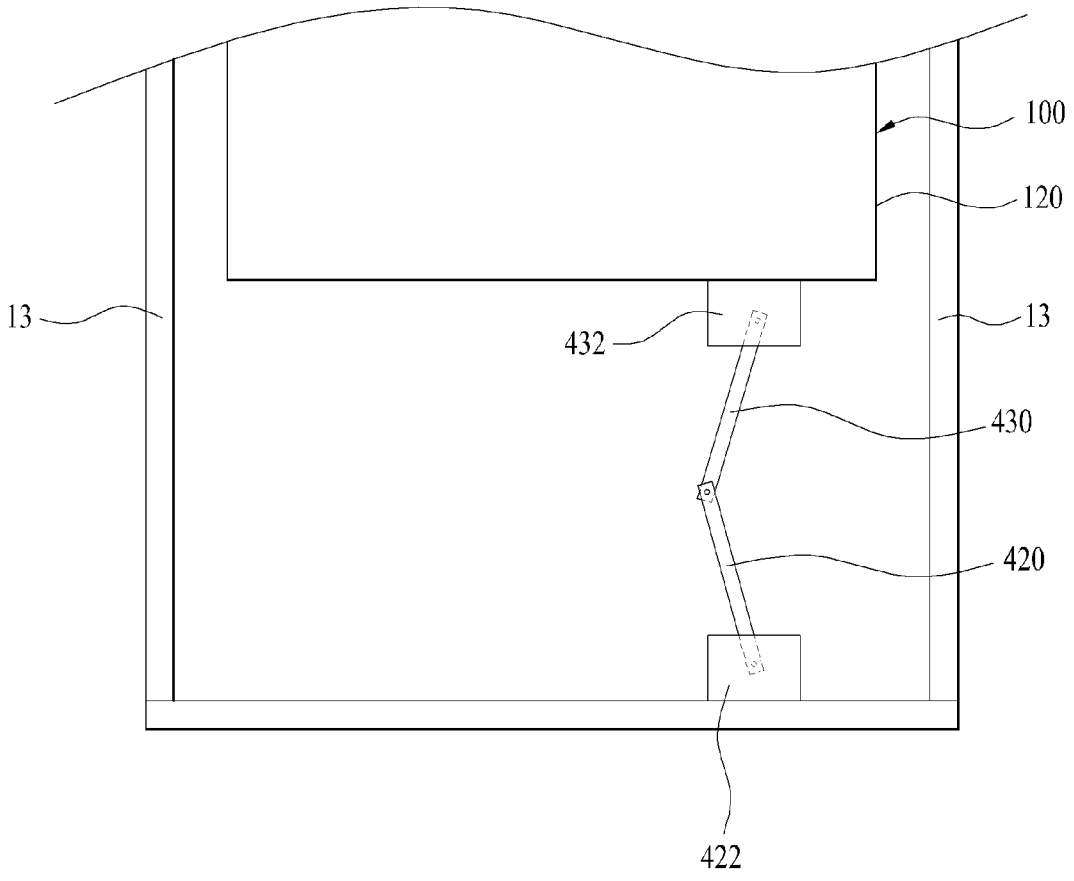
FIG. 12 is a plane view illustrating the water supply and drainage device of the laundry apparatus.

FIG. 10 is a rear view illustrating the drawer 100 which is moved into the second cabinet 20 completely and FIGS. 11 and 12 are side sectional and plane views illustrating the drawer 100 which is moved outward completely from the second cabinet 20.

In reference to FIG. 10, the first link 420 and the second link 430 are folded to be arranged on the same perpendicular plane. In other words, the first link 420 and the second link 430 are arranged in parallel to the rear surface of the housing 120. Together with that, the flexible water supply pipe 450 and the flexible drainage pipe 460 are bent in a "⊂" shape near the hinge-connecting portion of the first and second links 420 and 430. In other words, the flexible water supply pipe 450 and the flexible drainage pipe 460 exhausted from the first end of the first link 420 are bent gently to be inserted in the end of the second link 430.

In reference to FIG. 11, when the drawer 100 is led out, the first and second links 420 and 430 connected to the drawer 100 are not located on the same perpendicular plane anymore. In other words, the first link 420 is rotated about the connected portion with the rear panel of the second cabinet 20 and the second link 430 is rotated about the connected portion with the housing 120. Here, the second link 430 is rotated about all of the connected portions with the housing 120 and with the first link 420. In contrast, the first link 420 is only rotated about the connected portion with the rear panel.

In reference to FIG. 12, when the drawer 100 is led out completely, the first and second links 420 and 430 are located on the same perpendicular plane again. However, the second link 430 is not located underneath the first link 420 but at a diagonal angle with respect to the first link 420. It is preferable that the first and second links 420 and 430 maintain a predetermined angle, not located on the same perpendicular plane completely, when the drawer 100 is moved outward completely. In other words, if the first and second links 420 and 430 are placed on the same perpendicular plane in the state of the drawer 100 being led out completely, the first and second links 420 and 430 might not be rotated relatively when the drawer is led in again. In other words, if the first and second links 420 and 430 are located on the same perpendicular plane, a moment for rotating the first and second links 420 and 430 cannot be formed. Because of that, if the first and second links 420 and 430 maintain a predetermined angle when the drawer 100 is led out completely, the first and second links 420 and 430 may be rotated smoothly when leading in the drawer 100.

As a result, the water supply pipe 450 and the drainage pipe 460 of the auxiliary laundry device may be arranged effectively by the hinge assembly configured of the pair of the links. Twist or damage of the water supply pipe and the drainage pipe generated when leading in or out the drawer may be prevented accordingly.

When the second treating part 20*a* is formed in the drawer 100 as described above, the auxiliary laundry device may be a top loading type which allows the user to load laundry via a top thereof vertically. Because of that, the user may load or unload the laundry into or out of the drum 600 smoothly and conveniently after leading out the drawer 100.

As follows, the second tub and the second drum according to embodiments of the present invention will be described in detail in reference to the accompanying drawings.

Figure 13:
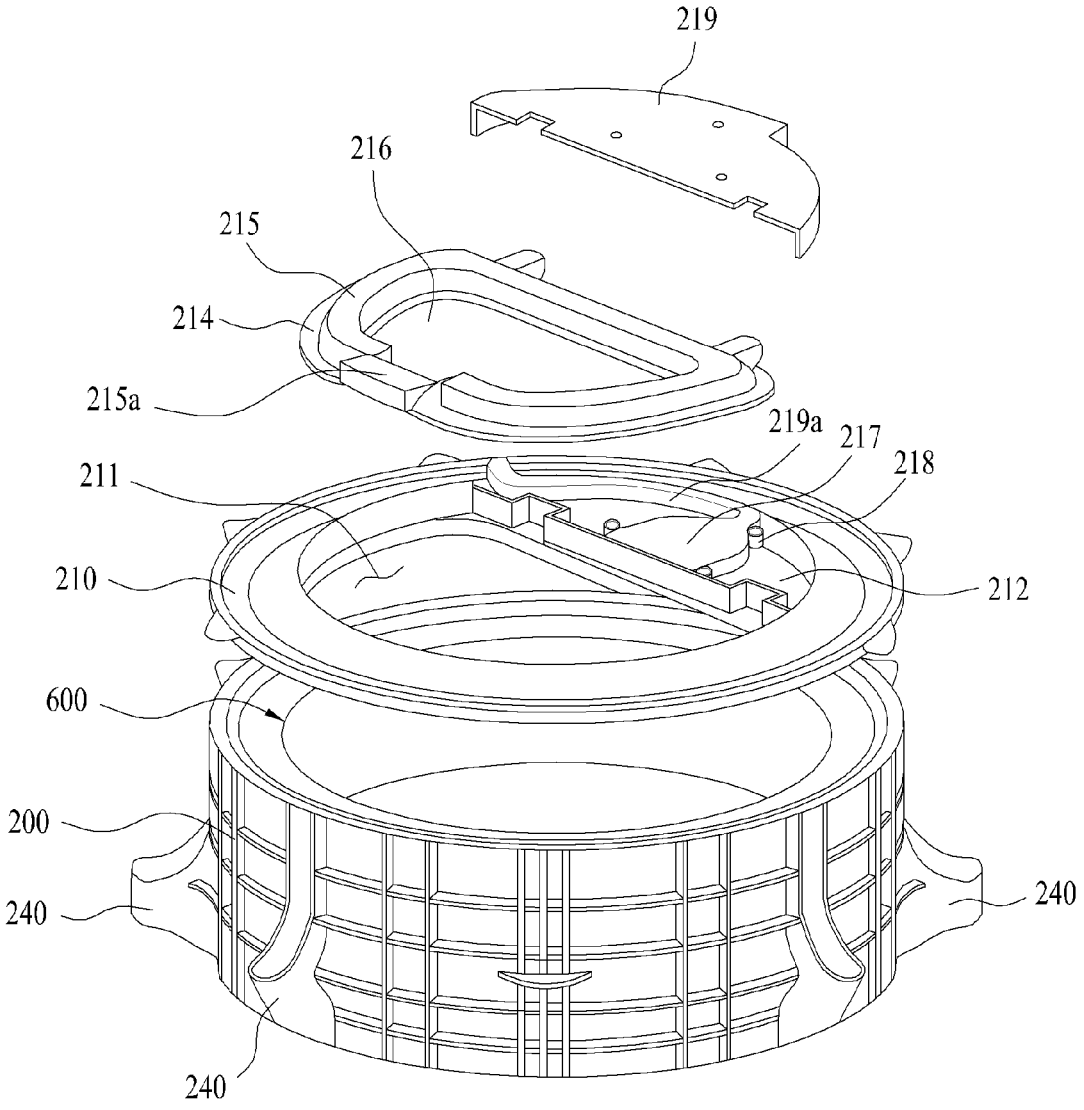
FIG. 13 is an exploded perspective view illustrating a second tub of the laundry apparatus.
Figure 14:
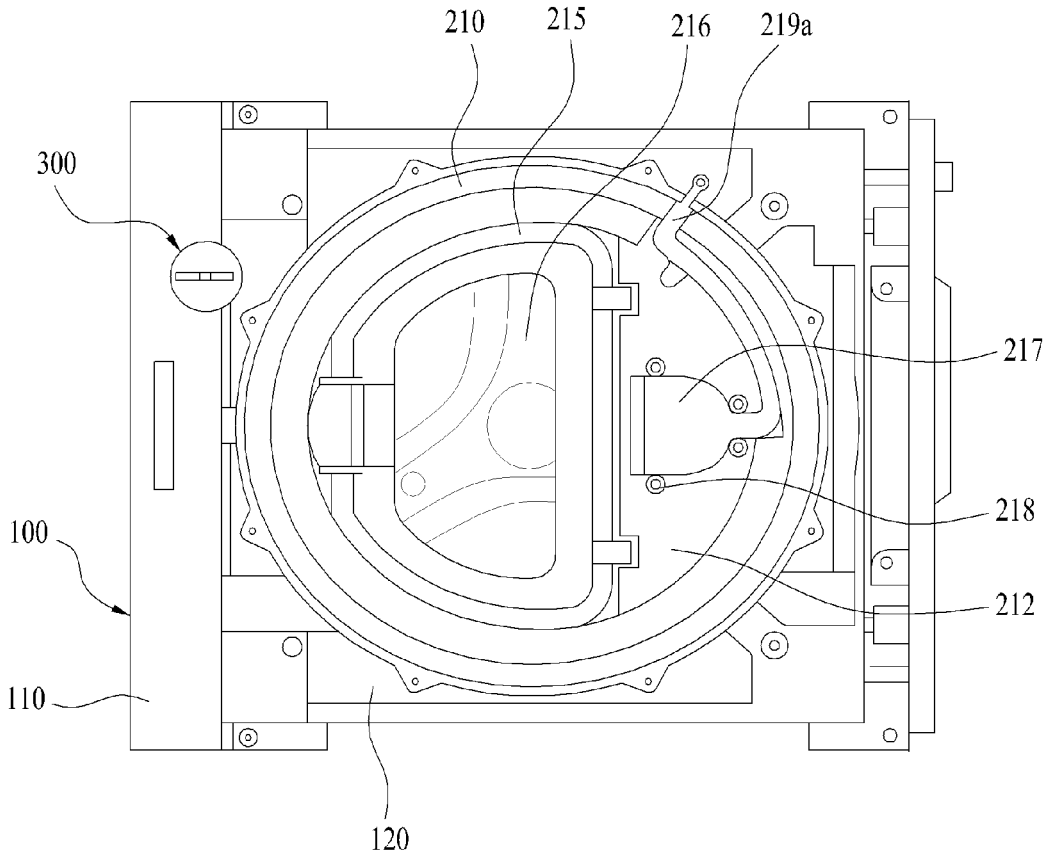
FIG. 14 is plane view illustrating the second tub of the laundry apparatus.

In reference to FIGS. 13 and 14, the second treating part 20*a* includes a second tub 200, a second drum 600 rotatably mounted in the second tub 200, a tub cover 210 coupled to a top surface of the second tub 200, a cover 214 coupled to the tub cover 210, a water chamber 217 and a water supply hose 219*a* configured to supply wash water to the second drum 600, and a water chamber cover 219 configured to cover the water chamber 217. The water chamber 217 is configured to reduce the speed of the wash water, which will be described in detail later.

The second tub 200 and the second drum 600 have open tops. The second tub 200 surrounds the second drum 600 and it prevents the wash water from leaking outside. The second drum 600 is rotatable within the second tub 200. The second drum 600 holds laundry and it is provided with the wash water. A plurality of ribs may be projected from an outer circumferential surface of the second tub 200 to reinforce the strength of the second tub 200.

The tub cover 210 prevents the wash water and the laundry from being thrown outside during the washing, and it is coupled to a top surface of the second tub 200. A semicircular-shaped opening 211 is formed in an inner circumference of the tub cover 210 and the opening 211 is an introduction space for the laundry to be loaded or unloaded. The opening 211 is opened and closed by the cover 214. The cover 214 is hingedly coupled to the tub cover 210 and the cover 214 is configured of a frame 215 and a transparent window 216 secured in the frame 215. A handle 215*a* used to open and close the cover 214 is provided in a center of the frame 215. The transparent window 216 is formed of a transparent material and it allows the user to identify the state of the laundry and wash water inside the second drum 600. The user opens the cover 214 before starting the washing process and he or she loads the laundry into the second drum 600. After the washing process, the user opens the cover 214 and he or she takes out the laundry from the second drum 600. During the washing process, the cover 214 is kept being closed.

A chamber support 212 is formed in a rear portion of the semicircular opening 211 formed in the tub cover 210 and the water chamber 217 is installed in the chamber support 212. A hinge is provided in the chamber support 212 to connect the cover 214 to the second cover.

The water chamber 217 is a device configured to supply the wash water to the second drum 600 and it is located in the center of the chamber support 212, adjacent to the opening 211. Here, the water chamber 217 communicates with an end of the water supply hose 219*a*. The water supply hose 219*a* is inserted in a predetermined portion of the tub cover 210 and it is arranged along an inner surface of the tub cover 210, that is, an outer surface of the chamber support 212. Together with that, the water supply hose 219*a* is bent at a center of the outer surface of the chamber support 212 to communicate with the water chamber 217. The other end of the water supply hose 219*a* is in communication with the flexible water supply pipe 450.

A support cover 213 is coupled to the chamber support and the support cover 213 is coupled with the chamber support 212, to form a predetermined internal space where the water chamber 217 is installed.

In the meanwhile, fixers 218 for fixing the water chamber 217 are formed around the water chamber 217 and bolt grooves are formed in the fixers 218 to couple the support cover 213 to the chamber support 212. The fixers 218 may be integrally formed with the support cover 213.

A cross section of the water chamber 217 is larger than a cross section of the water supply hose 219*a*. As the wash water is moving at a high speed via the water supply hose 219*a*, the speed of the wash water is decreased drastically at the water chamber 217. Because of that, the wash water may be supplied to the second drum 600 not at a high speed but at a relatively low speed.

According to the conventional laundry device, wash water is supplied to a drum from a predetermined portion of the second tub 200 or of the tub cover 210. Typically, most of the laundry is located in a center of the second drum 600 and the conventional laundry apparatus consumes quite a lot of time to dampen the laundry. However, according to an embodiment of the present invention, the water chamber 217 for supplying the wash water is arranged near the center of the second drum 600, to supply the wash water to the center of the second drum 600. Because of that, the time required for the wash water to dampen the laundry may be reduced effectively.

In the meanwhile, the opening 211 is approximately semicircular and the angle at the circumference is over 180 degrees, exactly. In other words, the opening 211 formed in the tub cover 210 may be larger than the space occupied by the chamber support 212. Because of that, the space for loading and unloading the laundry may be secured as much as possible.

As a result, the water chamber is arranged in the center of the drum according to the present invention to supply the wash water to the center of the drum, such that the laundry may be dampened more quickly.

Figure 15:
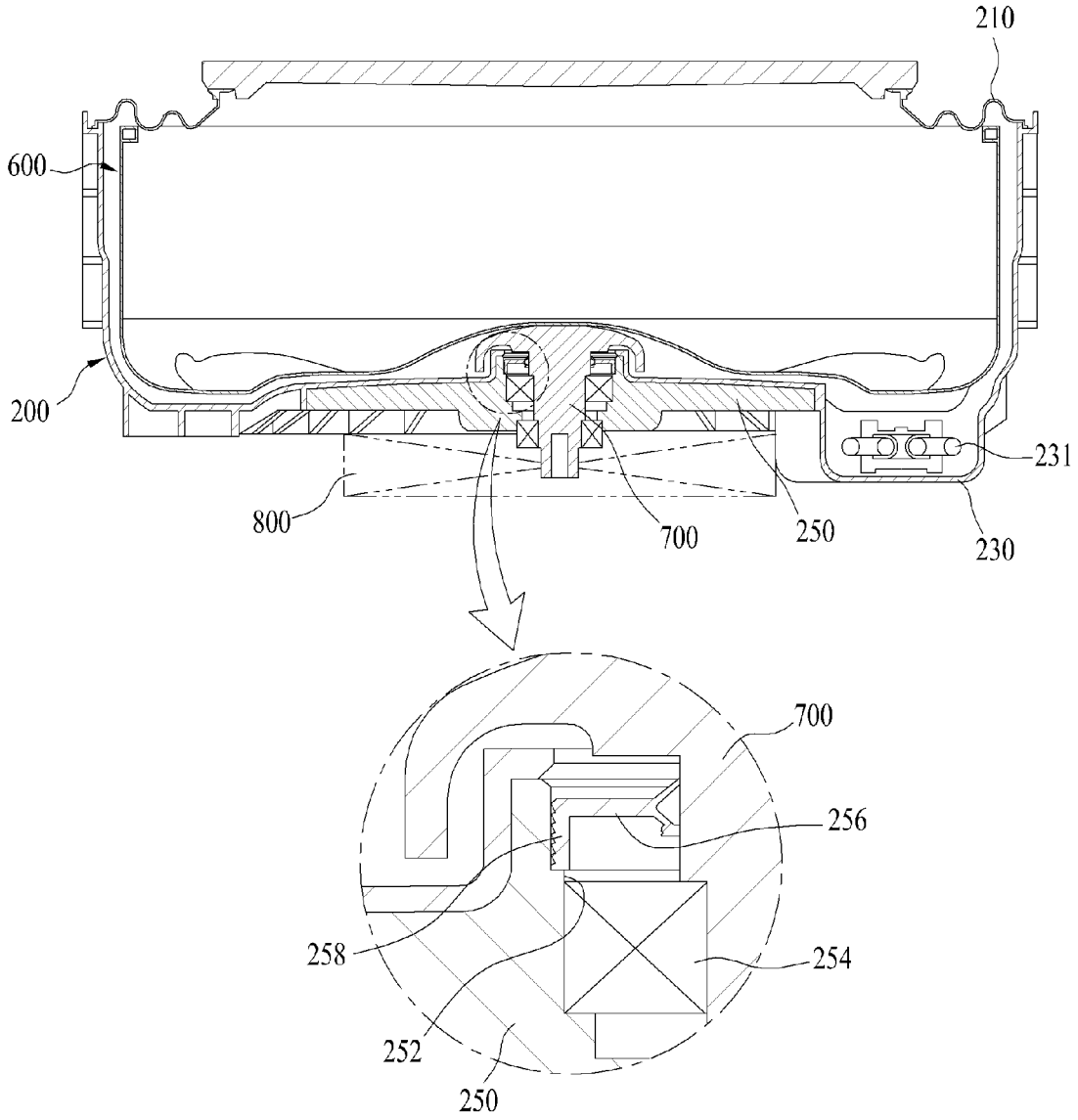
FIG. 15 is a sectional view illustrating the second tub and a second drum of the laundry apparatus.

In the meanwhile, as shown in FIG. 15, a shaft 700 passing through the second tub 200 is provided in a lower portion of the second tub 200. An upper end of the shaft 700 is connected with the drum 600 mounted in the second tub 200 such that the second drum 600 may be rotated along the rotation of the shaft 700. A motor 800 is installed underneath the second tub 200 to rotate the shaft 700.

Within the drawer 100, the second tub 200 is elastically supported by an auxiliary supporting device (500, see FIG. 19), which will be described later. Vibration generated by the rotation of the second drum 600 to be transferred to the second tub 200 may be suspended and reduced by the supporting device 500.

A through hole 222 to pass the shaft 700 there through may be formed in the center of the second tub 200. In addition, a bearing housing 250 configured to support the shaft 700 is inserted in a bottom of the second tub 200. Preferably, the bearing housing 250 is integrally formed with the second tub 200 when the second tub 200 is molded. Here, when the second tub 200 is formed according to injection molding, the bearing housing 250 may be insert-molded when the second tub 200 is injection-molded. Here, shaft holes 252 to pass the shaft 700 there through are formed in a center of the bearing housing 250 and a pair of bearings 254 to rotatably support the shaft 700 are inserted in the shaft holes 252. A water seal 256 is provided in the shaft hole 252 of the bearing housing 250 to maintain air tightness between the shaft 700 and the second tub 200, in contact with the shaft 700. The water seal 256 is formed in a ring shape, fixed to an inner circumferential surface of the bearing housing 250, and a sealing rib 258 is projected from an inner circumferential surface of the water seal 256 to maintain the air tightness.

The motor 800 is installed underneath the second tub 200 and it rotates the shaft 700 supported by the bearing housing 250. Here, the motor 800 may be an outer rotor type motor including a stator fixed to an outer circumferential surface of the shaft of the second tub 200 and a rotor fixed to the shaft, surrounding the stator.

Figure 17:
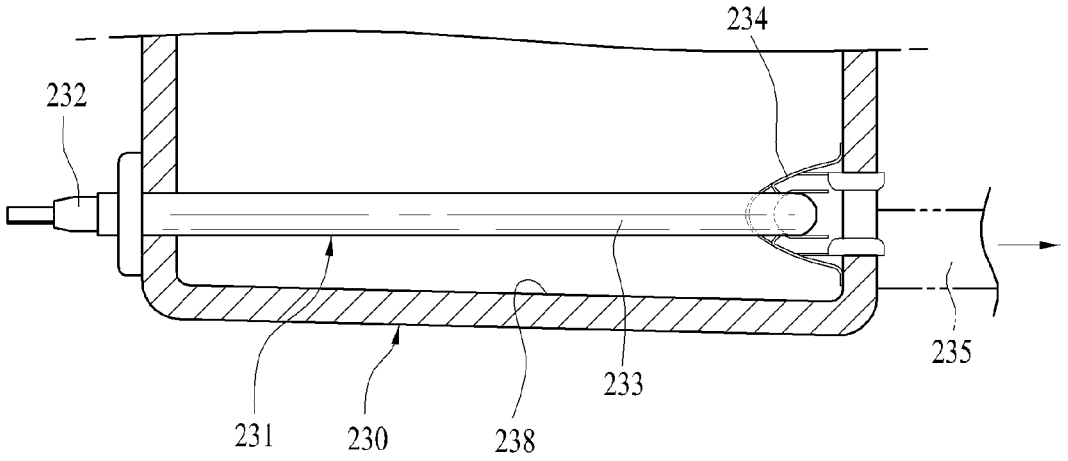
FIG. 17 is a sectional view illustrating a heater sump of the laundry apparatus.
Figure 18:
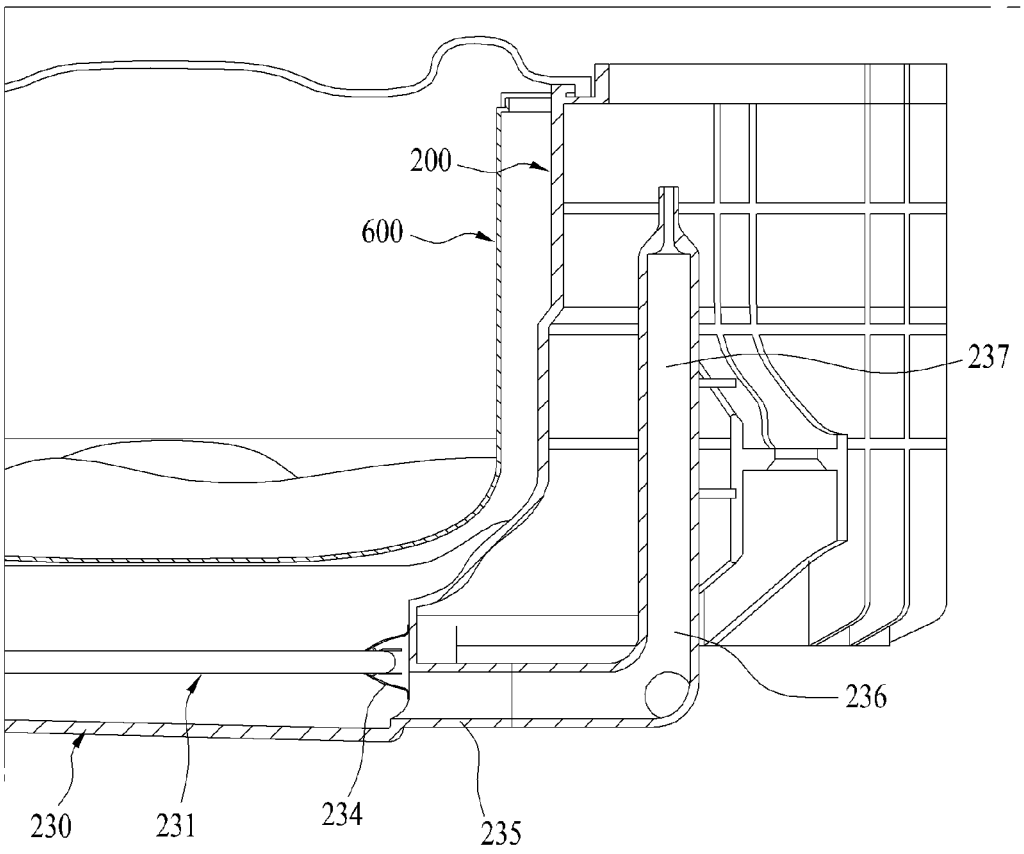
FIG. 18 is a sectional view illustrating an air chamber of the laundry apparatus.

As shown in FIGS. 16 to 18, a heater sump 230 may be formed in an inner lower surface of the second tub 200. A heater 231 is installed in the heater sump 230 to heat the wash water held in the second tub 200. A drainage part 235 is provided in the heater sump 230 to drain the wash water held in the second tub 200 and an air chamber 237 is installed in the drainage part 235 to sense the amount of the wash water held in the second tub 200.

Here, in reference to FIGS. 16 and 17, a sloping surface 238 is formed in the bottom of the second tub 200 to allow the wash water of the second tub 200 to be collected in the heater sump 230. In other words, when the wash water held in the second tub 20 is drained, the sloping surface 238 formed in the bottom of the second tub 200 helps the wash water collect in the heater sump 230 to be drained via the heater sump 230.

When the wash water held in the second tub 200 is heated, the sloping surface 238 collects the wash water in the heater sump 230 to be heated. In this case, even if the wash water is insufficient when heating the wash water, the wash water is collected in the heater sump 230 by the sloping surface 130. Because of that, overheating of the heater 231 and damage to the heater 231 may be prevented.

The heater sump 230 mentioned above cannot be formed at the relatively least space formed by the second tub 200 installed in the limited space of the drawer 100. In other words, only the least space having the heater 231 formed therein is used to form the heater sump 230.

In this case, the installation of the heater 231 itself may be a problem. The heater 231 includes a heater terminal 232 connected with the power source and a heating road 233. Simultaneously, the heater terminal 232 fixes the heater 231. Because of that, the size of the heater terminal 232 is relatively larger than the size of the heating road 233. Typically, the heater terminal 232 is bent along a perpendicular direction with respect to the heating road 233 for installation efficiency. However, according to the present invention, the heater terminal 232 is formed in the same direction as the heating road 233 because of the small space. As a result, even when the heater sump 230 is projected toward the lower portion of the second tub 200, the heater terminal 232 of the heater 231 is caught by the rib for reinforcing the strength of the second tub 200 when the motor 231 is installed and it interferes with the inserting path of the heater 232, which makes it difficult to install the heater 231.

Because of that, when the motor 231 is installed, the installation direction of the heater 231 is sloping from a lower portion of the heater sump 230 toward an upper portion. In other words, when the heater 231 is inserted, the heater 231 is inserted in the heater sump 230 with an end of the heating road 233 being upward and the heater terminal 232 being downward. After the heating road 233 is inserted completely, the heating road 233 is rotated horizontally to fix the heater terminal 232 to the heater sump 230.

Meanwhile, an auxiliary heater clamp 234 for fixing the heating road 233 of the inserted heater 231 may be installed in an inner surface of the heater sump 230. The heater clamp 234 supports the heater in a rightward and leftward direction.

Such the heater clamp 234 and the second tub 200 are manufactured independently and the heater clamp 234 is inserted in the heater sump 230 in advance before the heater 231 is installed. The heater clamp 234 is located in a predetermined position opposed to the inserting direction of the heater 231 and it fixes an end of the heating road of the heater 231. Here, the heater clamp 234 is inserted in the installation hole provided in the heater sump 230 by a predetermined elasticity and a hooking projection is projected in the end of the heater sump 230 to prevent the separation of the heater sump 230.

Additionally, because of the limited small space of the heater 231, the direction of the heater terminal 232 is identical to the direction of the heating road 233 to connect the power terminal (not shown) to the heater terminal 232.

In other words, when the direction of the heater terminal 232 is perpendicular to the direction of the heating road 233, like the conventional heater, the space formed between the second tub 200 and the drawer 100 is narrow and it is difficult to connect the power terminal with the heater terminal.

However, when the direction of the heater terminal 232 is identical to the direction of the heating road 233, the power terminal is inserted along the installation direction of the heater 231, to be connected with the heater terminal 232 smoothly.

Figure 26:
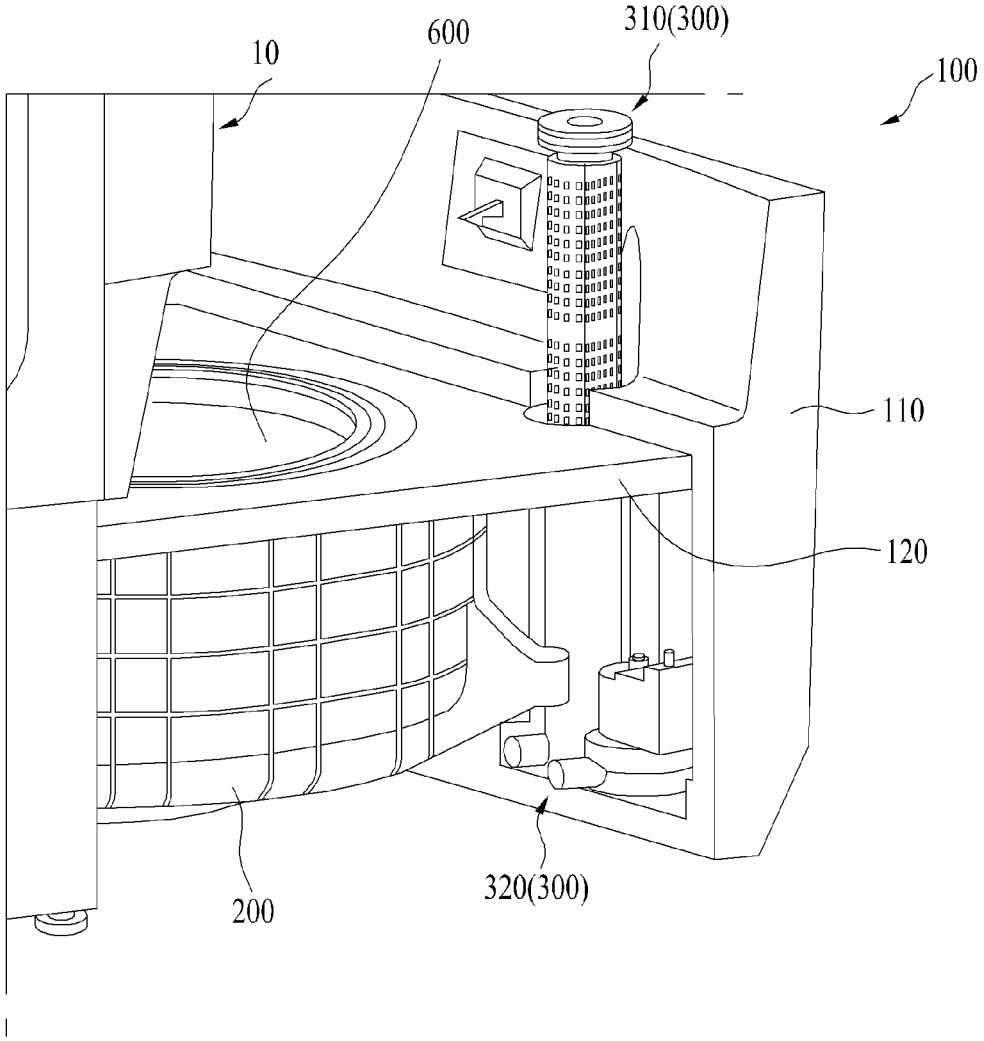
FIG. 26 is a perspective view illustrating an installation state of the drawing pump.
Figure 27:
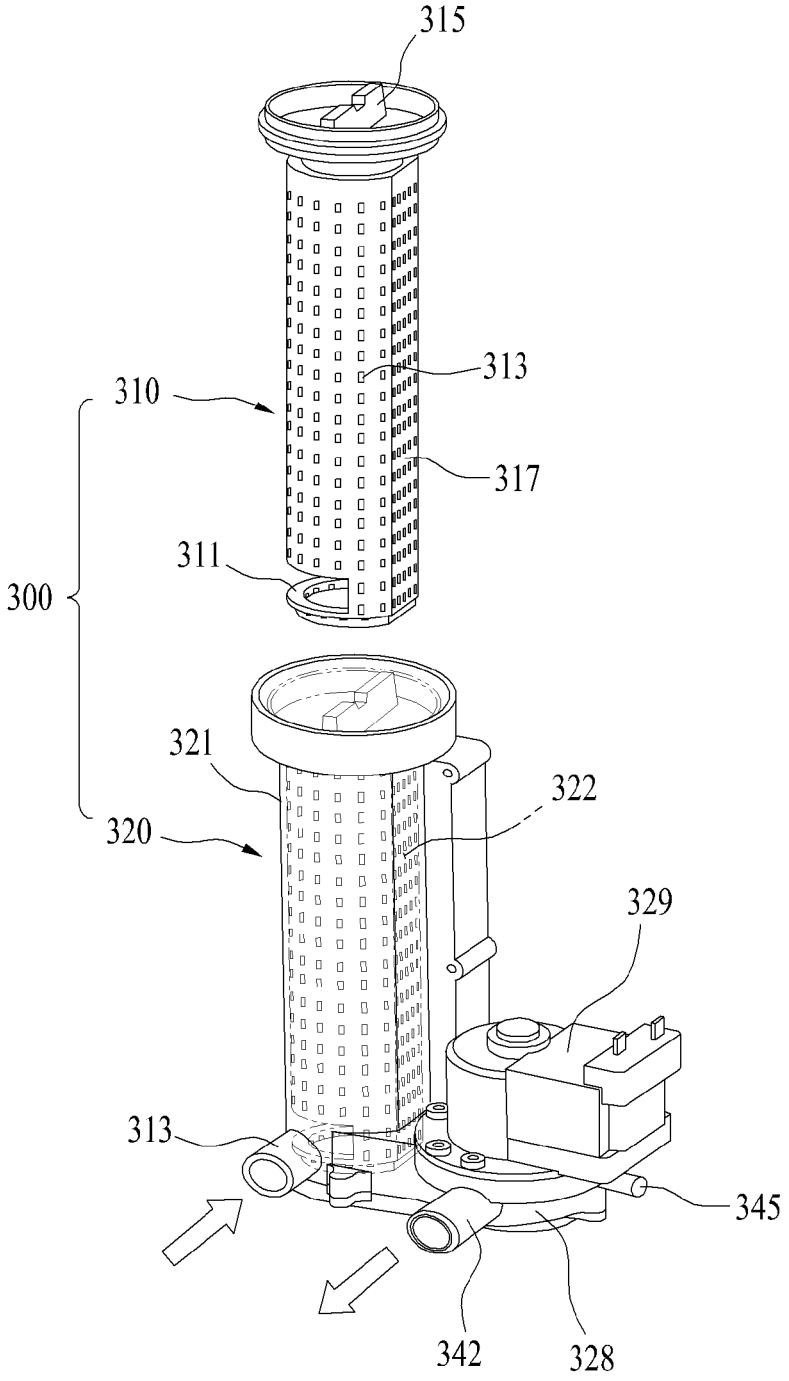
FIG. 27 is an exploded perspective view illustrating the drainage pump of the laundry apparatus.
Figure 28:
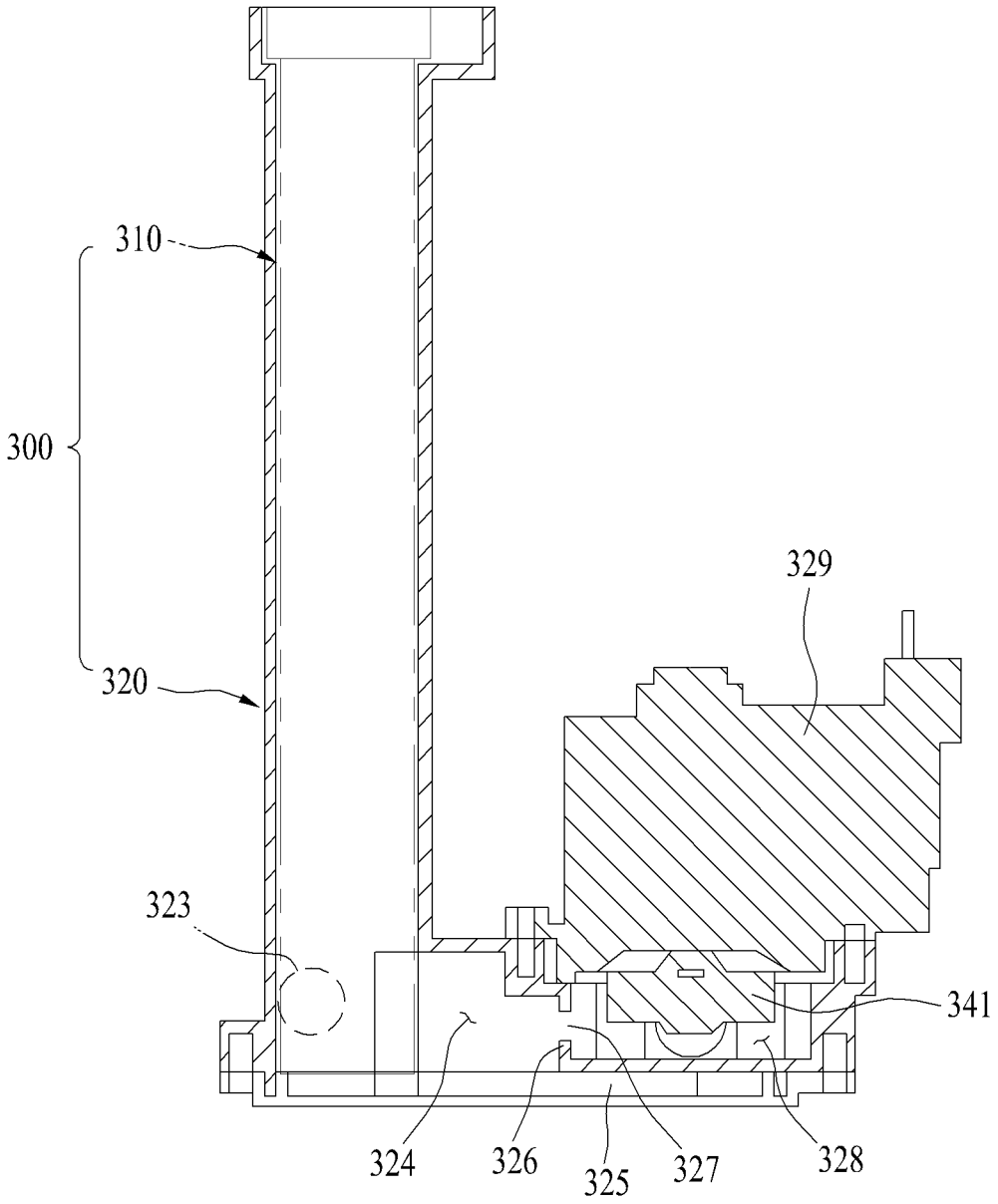
FIG. 28 is a sectional view illustrating the drawing pump of the laundry apparatus.
Figure 29:
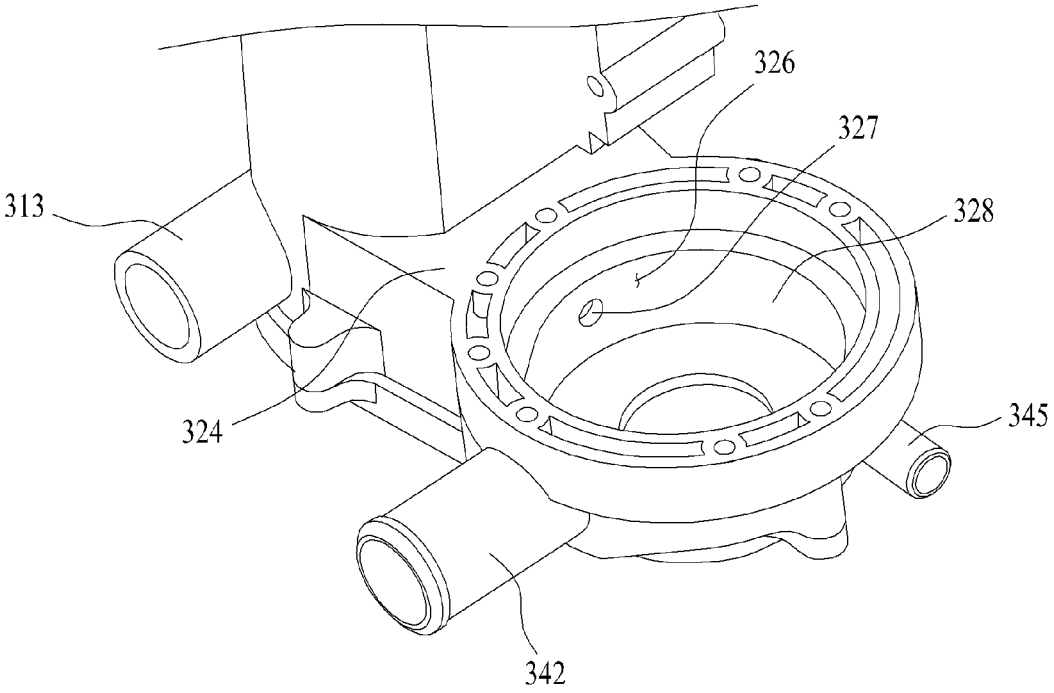
FIG. 29 is a perspective view illustrating a drainage chamber of the drainage pump provided in the laundry apparatus.

As shown in FIG. 18, the drainage part 235 is provided in a bottom of the heater sump 230 to drain the wash water held in the second tub 200 such the drainage part 235 is connected with a drainage device (not shown) and the wash water collected in the heater sump 230 is drained by a drainage pump (300, see FIG. 26) provided in the drainage device. The drainage pump 300 will be described in detail later.

Here, a branched pipe 236 branched toward a upper portion of the drainage part 235 is formed in the drainage part 235 and a pressure water level sensor (not shown, for example, a diaphragm pressure sensor) is connected with the branched pipe 236 to sense a water level of the wash water stored in the second tub 200. The air chamber 237 is provided between the branched pipe 236 and the pressure water level sensor. The air chamber 237 allows the pressure water level sensor to detect pressure changes of the branched pipe 236 by using a volume.

Meanwhile, the conventional laundry apparatus includes a suspension system which supports the drum and the tub and which reduces vibration generated by the rotation of the drum, such as a cylinder and a piston or a spring and a damper. Such a conventional suspension system is flexible according to the weights of the drum and the tub, to support the drum and the tub. Because of that, the drum and the tub may move downwardly a predetermined distance or more.

As a result, it is limited to install and drive the conventional suspension system in the narrow space of the second cabinet 20. As follows will be described a supporting device which is provided in the second cabinet 20 of the laundry apparatus 1 according to the above embodiments, to support the second drum 600 and the second tub 200 and to suspend the vibration generated by the rotation of the second drum 600 to limit the movement of the second drum 600 and the second tub 200.

Figure 19:
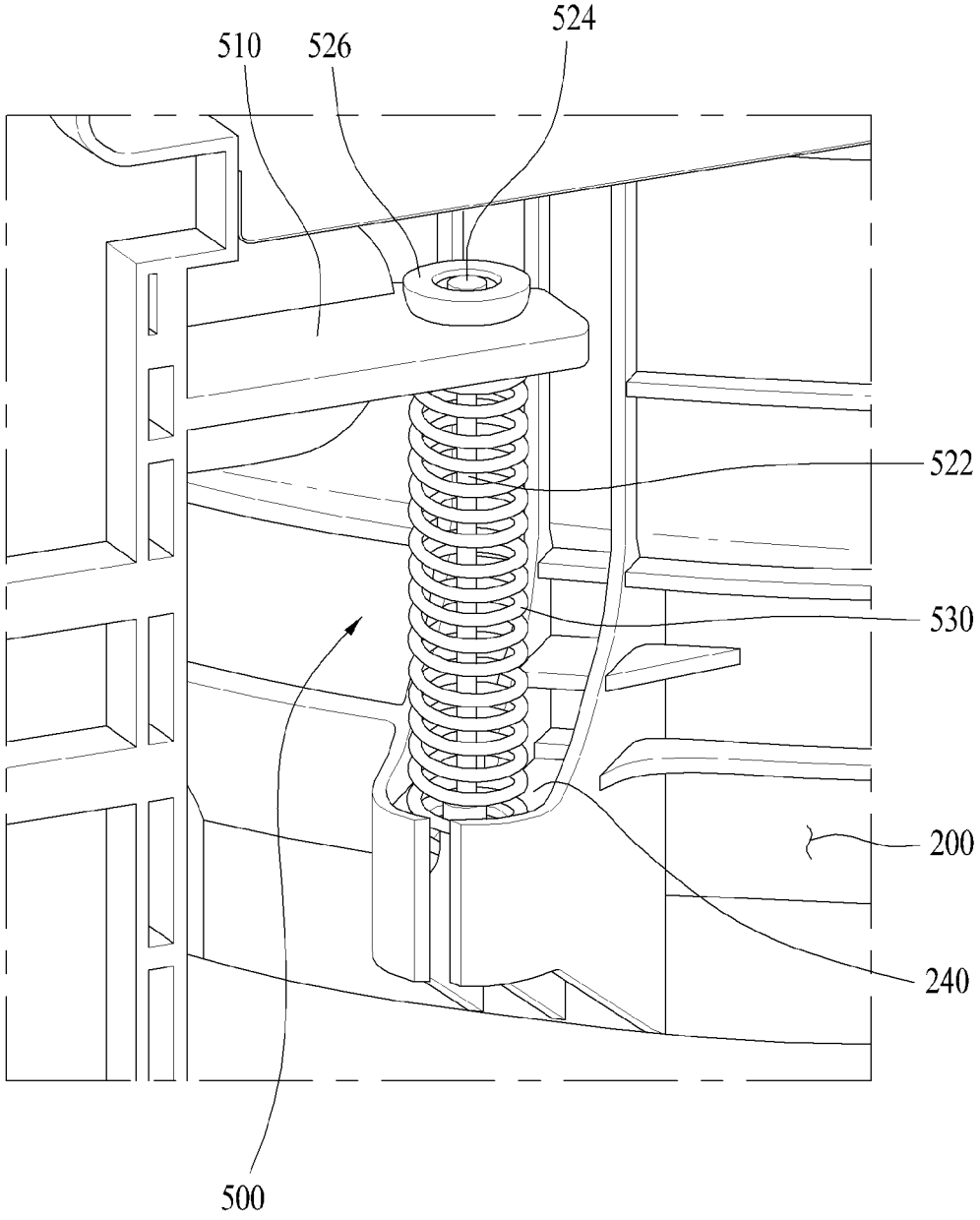
FIG. 19 is a partially perspective view illustrating a second tub supporting device of the laundry apparatus.
Figure 20:
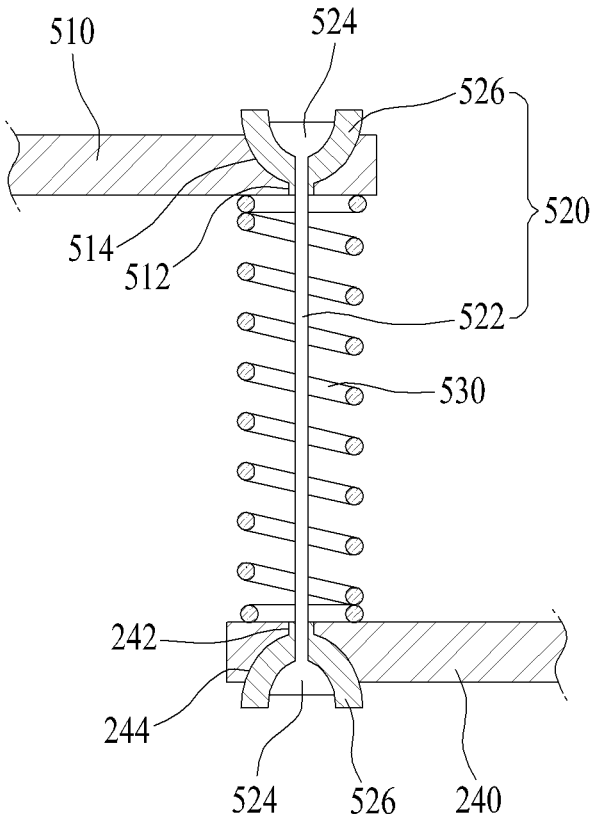
FIG. 20 is a sectional view illustrating the second tub supporting device of the laundry apparatus.

In reference to FIGS. 19 and 20, a supporting device 500 according to an embodiment may maintain the distance between the second tub 200 and the second cabinet 20 in a predetermined range. In other words, the supporting device 500 may prevent the second tub 200 and the second cabinet 20 from being spaced apart over the predetermined range or from being too closed over the range.

Here, when the drawer 100 is provided in the second cabinet 20 as mentioned above, the supporting device 500 is provided between the second tub 200 and the drawer 100 and it can maintain the distance between the drawer 100 and the second tub 200 in a predetermined range. In other words, according to an embodiment not including the drawer 100, the supporting device 500 may be provided between the second tub 200 and the second cabinet 20. According to an embodiment including the drawer 100, the supporting device 500 may be provided between the second tub 200 and the drawer 100. The embodiment including the drawer 100 provided in the second cabinet and the supporting device 500 provided between the second tub 200 and the drawer 100 will be described.

As a result, the supporting device according to this embodiment limits the movement of the second tub 200 and it can suspend horizontal vibration and/or vertical vibration which are generated by the rotation of the second drum 600. More specifically, the supporting device 500 may be provided between a first fixing part 510 provided in the drawer 100 and the sloping surface 240 provided in the second tub 200. In this case, the supporting device 500 may maintain the distance between the first fixing part 510 and the sloping surface 240 in a predetermined range. As follows, a specific configuration of the supporting device 500 will be described in reference to the drawings.

The supporting device 500 according to an embodiment includes a first supporting part 520 configured to limit downward movement and horizontal movement of the second tub 200 and a second supporting part 530 configured to limit upward movement of the second tub 200. The supporting device 500 according to the embodiment may include a supporting part configured to limit movement of the second tub according to vibration of the second tub generated by the rotation of the second drum 600, that is, a direction of movement of the second tub 200. Here, the first supporting part 520 may limit downward movement and leftward-and-rightward movement of the second tub 200. The second supporting part 530 may limit upward movement of the second tub 200.

In the meanwhile, the second drum 600 and the second tub 200 may be vibrated along various directions by the rotation of the second drum 600. For example, they may be vibrated along a vertical direction or a horizontal direction. Even when they are vibrated along the vertical direction, the second drum 600 and the second tub 200 may be vibrated linearly or curvedly, and vice versa when they are vibrated along the horizontal direction. By extension, when the second tub 200 and the second drum 600 are rotated, only a single direction rotation will occur rarely and vibration having complex directional elements will usually be generated. For example, they are vibrated vertically and vibrated horizontally along a curvature at the same time.

When limiting the downward and horizontal movement of the second tub 200, the first supporting part 520 can limit the upward movement of the second tub 200 simultaneously. Here, the first supporting part 520 can limit the downward and horizontal vibration of the second tub 200 mainly, with limiting the upward movement of the second tub 200 additionally. This can be applied to the second supporting part 530. In other words, the second supporting part 520 can limit the upward movement of the second tub 20 mainly, with limiting the downward and/or horizontal movement of the second tub 200 additionally.

The first and second supporting parts 520 and 530 mentioned above may be provided between the second tub 200 and the drawer 100. For example, the first and second supporting parts 520 and 530 may be provided between the first fixing part 510 provided in the side wall of the second tub 200 and the sloping surface 240 provided in the inner wall of the drawer 100. The first fixing part 510 may be integrally formed with the side wall of the second tub 200 and the sloping surface 240 may be integrally formed with the inner wall of the drawer 100.

In the meanwhile, to provide the first and second supporting parts 520 and 530 between the first fixing part 510 and the sloping surface 240, the first fixing part 510 may face the sloping surface 240 in opposite. Furthermore, they may face each other in opposite along a perpendicular direction. The first and second supporting parts 520 and 530 may be provided along a perpendicular direction accordingly.

For example, as shown in FIG. 19, the first fixing part 510 is provided in an upper portion of the supporting device 500 and the sloping surface 240 is provided lower than the first fixing part 510, such that they are opposing each other along a perpendicular direction. The first fixing part 510 may be extended outwardly from the side wall of the second tub 200 and the sloping surface 240 may be extended toward the second tub 200 from the inner wall of the drawer 100.

Here, the first supporting part 520 may include a supporting bar 522 configured to limit the moving distance of the second tub 200 according to a moving direction and a connecting portion 526. In other words, the supporting bar 522 is configured to limit the downward movement of the second tub 200 and the connecting portion 526 is configured to limit the rightward and leftward movement of the second tub 200.

Specifically, the supporting bar is substantially formed of a rigid material and both ends of the supporting bar 522 may be connected with the first fixing part 510 and the sloping surface 240, respectively. First and second inserting portions 512 and 242 may be provided in the first fixing part 510 and the sloping surface 240, respectively, to connect the ends of the supporting bar 522 there with. Because of that, the ends of the supporting bar 522 may be connected with the first fixing part 510 and the sloping surface 240, passing through the first and second inserting portions 512 and 242. In addition, a separation preventing portions 524 may be provided in the ends of the supporting parts to prevent the ends from separating from the first fixing part 510 and the sloping surface 240. Here, the connecting portions 526 may be provided between the separation preventing portion 524 and the first fixing part 510 and between the separation preventing portion 524 and the sloping surface 240, respectively.

According to this embodiment, the first fixing part 510 and the sloping surface 240 may be opposite to each other along a perpendicular direction and the supporting bar 522 provided between them may be provided along a perpendicular direction. Because of that, when the laundry is accommodated in the second drum 600 and the wash water is held in the second tub 200, a predetermined tension may be applied to the supporting bar 522 by the loads of the second drum 600 and the second tub 200.

Meanwhile, the supporting bar 522 may be substantially formed of a rigid body and both ends of the supporting bar 522 may be prevented from being separated from the first fixing part 510 and the sloping surface 240. Even when the tension is applied to the supporting bar 522 along the perpendicular direction by the loads of the second drum 600 and the second tub 200, the supporting bar 52 may stop the second tub 200 from moving downwardly as far as the length of the supporting bar 522, or farther than the length. In other words, even if the second tub 200 is moved downwardly by the rotation or vibration of the second drum 600, the downward movement of the second tub 200 may be limited by the supporting bar 522.

In the meanwhile, the upward movement of the second tub 200 generated by the rotation or vibration of the second drum 600 may be limited by the second supporting part 530. Here, the second supporting part 530 may be provided between the first fixing part 510 and the sloping surface 240 and it may be formed of an elastic member capable of providing an elastic force to both ends thereof. In other words, the second supporting part 530 may be compressed between the first fixing part 510 and the sloping surface 240 and it supplies the elastic force to the ends thereof, that is, to the first fixing part 510 and the sloping surface 240. As a result, the upward movement of the second tub 200 may be limited by the elastic force of the second supporting part 530. In addition, the separation preventing portions 524 provided at the ends of the supporting bar 522 may be in close contact with the connecting portion 526 by the elastic force of the second supporting part 530, such that the connecting portions 526 may be in close contact with the first fixing part 510 and the sloping surface 240. Because of that, the distance between the first fixing part 510 and the sloping surface 240 may be maintained in the predetermined range by the supporting bar 522 and the elastic material 540, only to limit the vertical movement of the second tub 200. When the second supporting part 530 is provided between the first fixing part 510 and the sloping surface 240, the second supporting part 530 may be provided along an outer circumference of the supporting bar 522.

Moreover, the horizontal movement of the second tub 200 generated by the rotation of the second drum 600 may be limited by the connecting portion 526 of the first supporting part 520 mentioned above. Here, the connecting portions 526 may be provided in both ends of the supporting bar 522 and they may limit the horizontal movement of the second tub 200 by using a frictional force with the fixing part 510 and the sloping surface 240. For example, the second tub 200 is vibrated to receive a predetermined force for moving horizontally. If then, the supporting bar 522 may receive a moment to be rotated between the first fixing part 510 and the sloping surface 240. In this case, if the supporting bar 522 is not configured to be rotated at all, the moment applies a tension to the supporting bar 522 and damage to the supporting bar 522 might occur.

Because of that, the supporting bar 522 may be configured to be rotatable to a predetermined angle with respect to the first fixing part 510 and the sloping surface 240. In this case, the rotation of the supporting bar 522 may be limited by the connecting portions provided at the ends of the supporting bar 522 and the frictional force between the first fixing part 510 and the sloping surface 240. As a result, the horizontal movement of the second tub 200 may be prevented.

The configuration of the rotatable supporting bar 522 will be specifically described as follows. First and second seating portions 244 and 514 may be provided in the first fixing part 510 and the sloping surface 240 to seat at least a predetermined portion of the connecting portions thereon. The connecting portion 526 may have a semicircular, circular or curved shape and the first and second seating portions 244 and 514 may have corresponding shapes with respect to the connecting portions 526, respectively. As a result, the shape of the connecting portions 526 provided at the ends of the supporting bar 522 and the shapes of the first and second seating parts 244 and 514 enable the supporting bar 522 to perform the rotation to a predetermined angle. The frictional force generated between contacting surfaces may be calculated according to a following mathematical equation:

$$F=\mu N \qquad \text{[Mathematical Equation]}$$

Here, 'μ' refers to a frictional coefficient and 'N' refers to a normal force. To increase the frictional force between the connecting portions 526 and the first fixing part 510 and the sloping surface 240, specifically, the frictional force between the connecting portion 526 and the first fixing part 510 and between the connecting portion 526 and the sloping surface 240, the connecting portions 526 and the first and second seating portions 244 and 514 may be formed of a material having a high frictional coefficient. To increase the normal force, the connecting portions 526 and the first and second seating portions 244 and 514 are contacting with each other as closely as possible.

According to the supporting device 500 of this embodiment, surfaces of the connecting portions 526 and/or surfaces of the first and second seating portions 244 and 514 provided in the sloping surface 240 and the first fixing part 510 may be formed of a material having a high frictional coefficient. According to this embodiment, to increase the normal force, the connecting portions 526 and the first and second seating portions 244 and 514 may contact with each other as closely as possible and at least one of the connecting portions 526 or the first and second seating portions 244 and 514 may include an elastic member to prevent any gap from being generated between them. In other words, the elastic force of the second supporting part 530 mentioned above enables the first fixing part 510 and the sloping surface 240 to be in close contact with the connecting portions 526, and the elastic member enables the connecting portions 526 and the first and second seating portions 244 and 514 to contact with each other as closely as possible, to increase the normal force.

Figure 21:
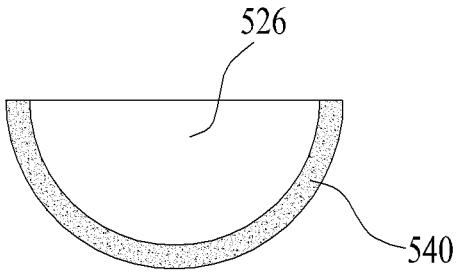
FIGS. 21 and 22 are sectional view illustrating a connected portion of the second tub supporting device.
Figure 22:
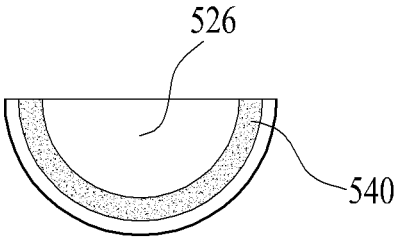

FIGS. 21 and 22 are diagrams schematically illustrating a connecting member including the elastic member.

The elastic member 540 may be exposed along an outer circumference of the connecting portion 526 as shown in FIG. 21 or at least a predetermined portion of the elastic member 540 may be embedded in the connecting portion 526 as shown in FIG. 22. When the elastic member 540 is embedded in the connecting portion 526, it is preferable that the elastic member 540 is not embedded in the connecting portion 526 more than a predetermined depth, to allow the connecting portion 526 to be in contact with the first and second seating portions 244 and 514 closely by the elastic force thereof.

When the horizontal vibration of the second tub 200 is generated by the rotation of the second drum 200, the second tub 200 happens to contact with the supporting device 500, to generate inference with each other. Especially, according to the above embodiments of the laundry apparatus, the second cabinet 20 has a relatively narrow internal space and the distance between the second tub 200 and the drawer 100 could be relatively narrow, compared with the conventional laundry apparatus. Because of that, the supporting device 500 provided between the second tub 200 and the drawer 100 may be provided adjacent to the second tub 200 closely. If the interference is generated between the second tub 200 and the supporting device 500 by the horizontal vibration of the second tub 200, there might be damage to an outer wall of the second tub 200 and damage to the supporting device 500. Because of that, the supporting device 500 cannot function well and noise and vibration of the laundry apparatus 1 might then increase. As follows will be described a configuration used to prevent the interference between the second tub 200 and the supporting device 500 even if vibration is generated in the second tub 200.

Figure 23:
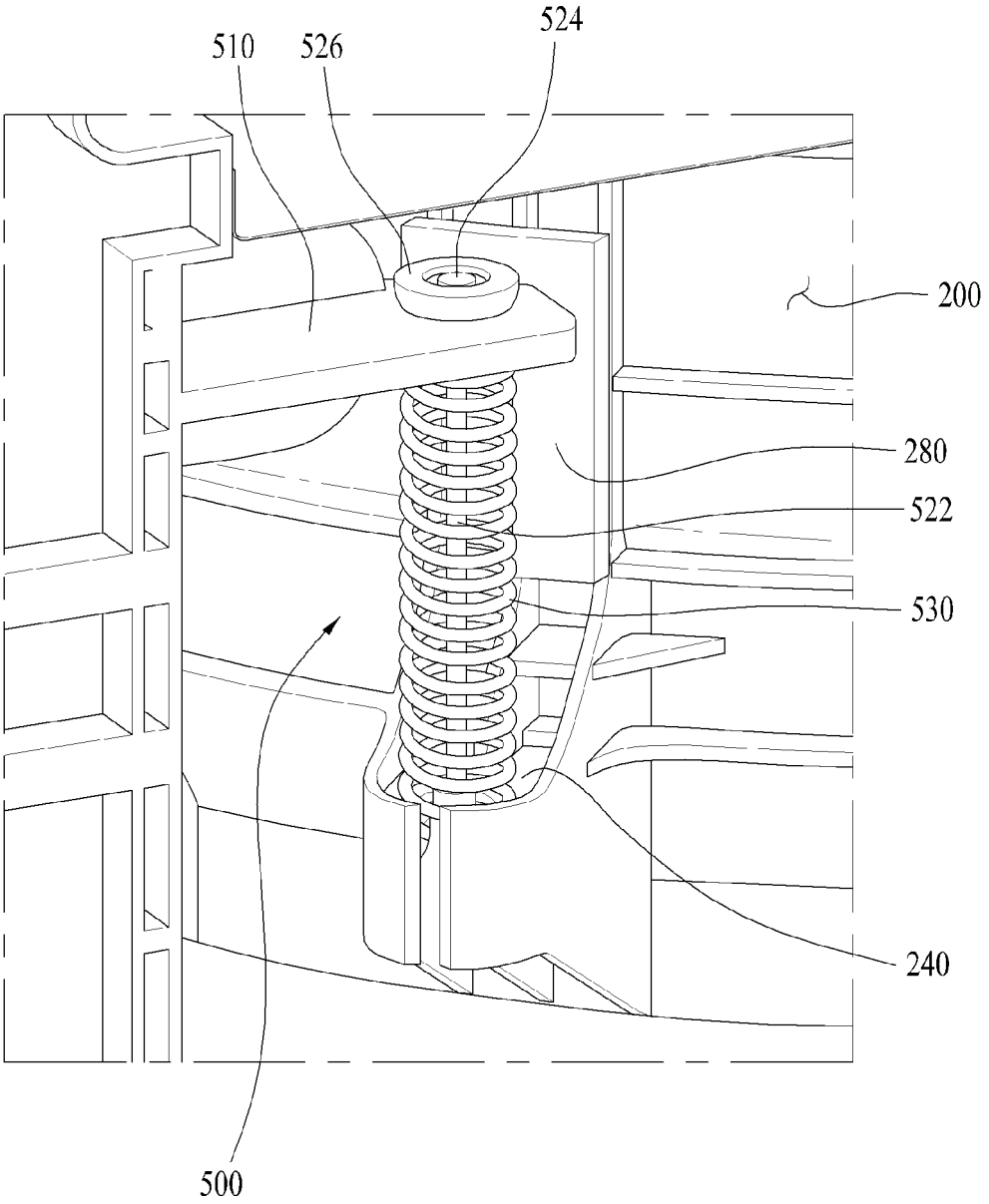
FIG. 23 is a partially perspective view illustrating another embodiment of the second tub supporting device.

In reference to FIG. 23, a laundry apparatus 1 according to another embodiment may include a damping material 280 configured to maintain a predetermined distance or more between the supporting device 500 and the second tub 200 to prevent interference generated between them. The damping material 280 may have a predetermined elastic force and it is provided between the supporting device 500 and the second tub 200, to prevent the interference between the second tub 200 and the supporting device 500 even if the second tub 200 is vibrated. The damping material 280 may be provided in at least one of the supporting device 500 and the second tub 200, for example, it may be provided along an outer circumference of the second tub 200 as shown in FIG. 23.

Meanwhile, the supporting device 500 provided in the laundry apparatus 1 according to some embodiments damps the vibration of the second tub 200. However, in case of damping the vertical and/or horizontal vibration of the second tub 200, the supporting device 500 may be provided along at least three portions or more along the outer circumference of the second tub 200. When the plurality of the supporting devices 500 are provided at two portions along the outer circumference of the second tub 200, a yawing phenomenon might be generated with respect to the supporting device 500.

Figure 24:
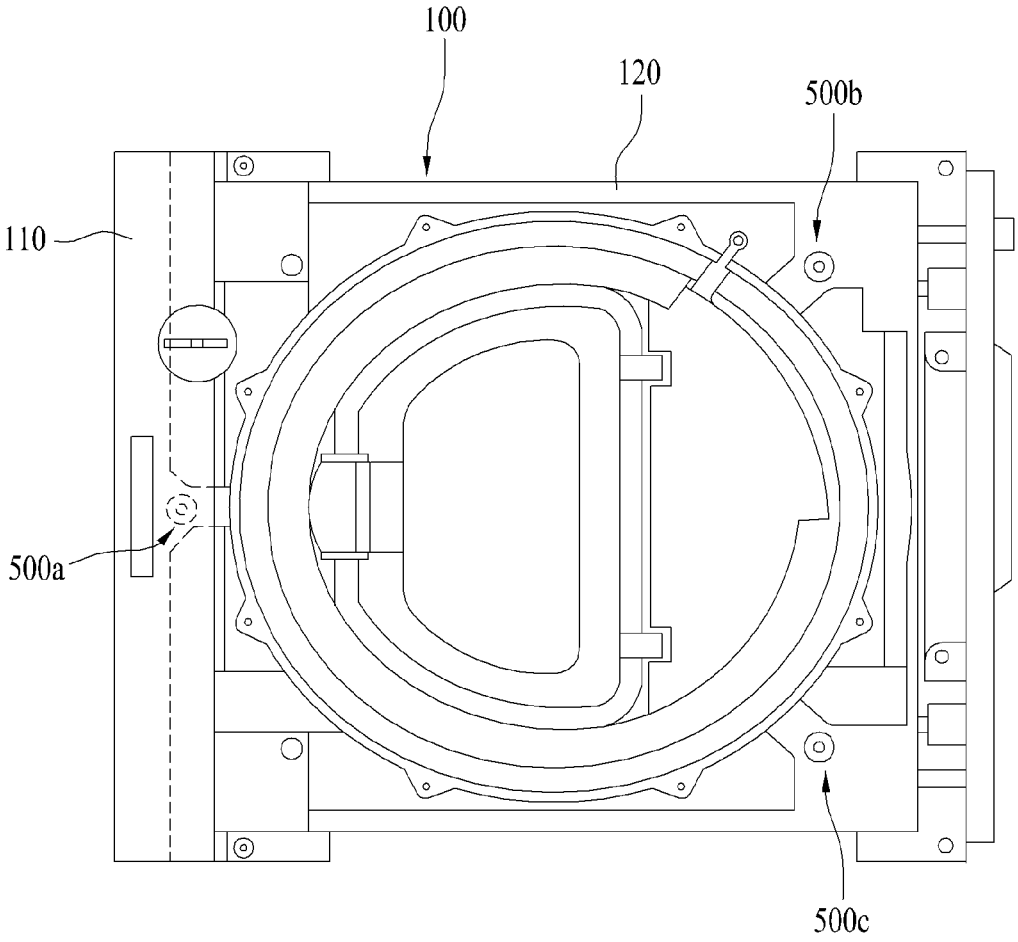
FIG. 24 is a plane view illustrating a second tub supporting device of the second tub supporting device according to another embodiment.

FIG. 24 is a plane view of the drawer 100 when the drawer 100 is provided in the second cabinet 20. FIG. 24 illustrates three supporting devices 500 provided in the laundry apparatus along the outer circumference of the second tub 200.

In reference to FIG. 24, the supporting device 500 according to this embodiment includes a first supporting device 500*a* provided in a front surface of the second tub 200 and second and third supporting devices 500*b* and 500*c* provided to form the same angle with the first supporting device 500*a*. For example, the second and third supporting devices 500*b* and 500*c* may be located approximately adjacent to rear corners of the drawer 100. An angle formed between the first supporting device 500*a* and the second supporting device 500*b* and an angle formed between the first supporting device 500*a* and the third supporting device 500 may be approximately 120°~60°. An angle formed between the second supporting device 500*b* and the third supporting device 500*c* may be approximately 120°~60°.

As mentioned above, the laundry apparatus 1 according to the present invention includes the supporting device 500 configured to prevent the vibration of the second tub 200, to reduce noise and vibration generated therein.

When the second cabinet 20 is provided, the laundry apparatus 1 according to the present invention may include the supporting device 500 which can be installed in the narrow internal space of the second cabinet 20 smoothly.

Meanwhile, it is necessary to provide a drainage pump 300 provided in the second tub 200 of the second treating part 20*a* to drain the wash water having treated the laundry. The wash water drained from the second treating part 20*a* is drained via a second drainage pipe 480 and an auxiliary drainage pump 300 for smooth drainage of the wash water. The drainage pump 300 mentioned above is configured to perform drainage of wash water and to filter dirt drained together with the wash water simultaneously. However, this embodiment requires a new structured drainage pump 300 because of the narrow installation space formed in the second treating part 20*a*.

As follows, the drainage pump 300 according to this embodiment will be described in detail in reference to the accompanying drawings.

Figure 25:
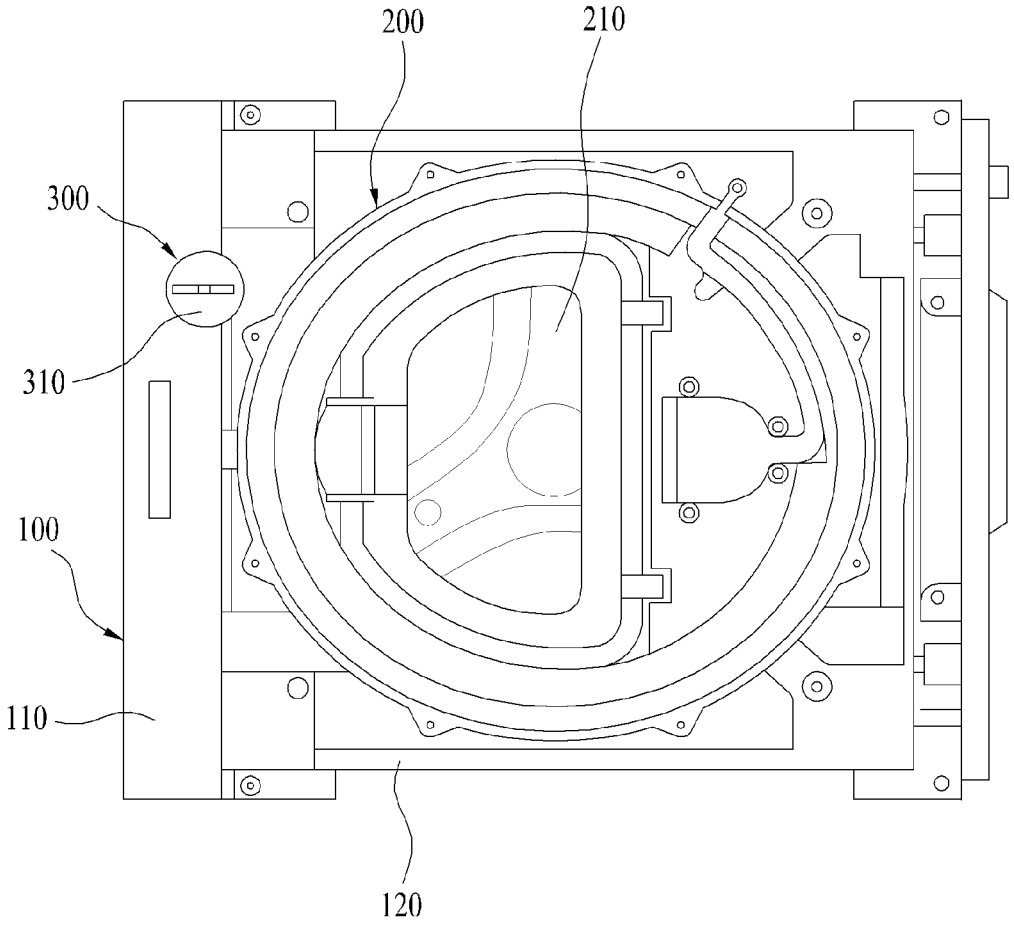
FIG. 25 is a plane view illustrating an installation location of a drainage pump provided in the laundry apparatus.

As shown in FIG. 25, the drainage pump 300 according to an embodiment of the present invention is installed in a front edge portion of the drawer 100. The drainage pump is configured of a filter part 310 and a pump part 320. The pump part 320 is installed in the drawer 100 and the filter part 310 is detachably installed in an upper horizontal direction of the drawer 100.

The reason why the filter part 310 is detachably in an upper portion of the drawer 100 vertically is that the installation space for the pump part 320 installed in the drawer is very narrow. In other words, if the filter part 310 is detachable forward or sideward with respect to the drawer 100, a filtering area of the filter part 310 is reduced possibly making it difficult to perform smooth filtering. However, if the filtering effect of the filter part 310 is enough, the filter part 310 could be detached along a forward or sideward direction of the drawer 100.

As shown in FIGS. 26 to 29, the filter part 310 and the pump part 320 of the drainage pump may be detachabed vertically.

Here, the filter part 310 is formed in a cylindrical shape having a hollow formed therein and it includes an inlet hole 311 formed in a lower portion thereof to draw the wash water therein and a plurality of filter holes 313 formed in an outer circumferential surface thereof, except the inlet hole 311, to filter the wash water. A handle 315 is provided in a top of the filter part 310 to detach the filter part 310 from the pump part 320. Here, a cut-out plane surface 317 is formed in a body of the filter part 310 to limit the insertion direction of the filter part 310.

In the meanwhile, the pump part 320 includes a filter coupling part 321 configured to couple the filter part 310 thereto insertedly, a drainage chamber 328 in communication with the filter coupling part 321 and a pump 329 provided in the drainage chamber 328 to generate a pumping power.

Here, the filter coupling part 321 is formed in a cylindrical shape, with an open top to allow the filter part 310 to be inserted therein and a hollow formed therein. A raised surface 322, corresponding to the cut-out surface 317 formed in the filter part 310, is formed in an inner surface of the filter coupling part 321. The insertion direction of the filter part 310 inserted in the filter coupling part 321 is determined by the shape of the raised surface 322 and the shape of the cut-out surface 317 corresponding to the raised surface 322.

The filter coupling part 321 forms a relatively broad space, compared with the filter part 310. A predetermined space where the wash water drawn via the inlet hole of the filter 310 passes the filter hole 313 of the filter part 310 is formed in the filter part 310.

Meanwhile, a water inlet hole 323 corresponding to the inlet hole 311 of the filter part 310 is formed in a lower portion of the filter coupling part 321 to draw the wash water therein. It is preferable that the water inlet hole 323 contacts with the inlet hole 311 formed in the filter part 310 closely to supply the wash water drawn via the water inlet hole 323 toward the inlet hole 311.

A wash water staying space 324 extending from the filter coupling part 321 is formed in the lower portion of the filter coupling part 321. A drainage path 325 to pass the wash water filtered by the filter part 310 therein is formed underneath the wash water staying space 324. The drainage path 325 forms a moving passage of the wash water toward a lower center of the drainage chamber 328 which will be described later, specifically, a center of an impeller 341 of the pump 329 which will be described later.

The drainage chamber 328 is located adjacent to the filter coupling part 321, beyond the drainage path 325 extended from the lower portion of the filter coupling part 321. The pump 329 is installed in the drainage chamber 328 and an impeller 341, rotated by the rotation of the pump 329, is located in the drainage chamber 328.

Moreover, a water outlet hole 342 is formed in a predetermined portion of the drainage chamber 328 to drain the wash water therethough by the rotation of the impeller 341. A drainage hole 345 is additionally formed in an opposite portion of the water outlet hole 342 to drain the wash water remaining in the drainage chamber 328 in the maintenance of the drainage pump 300. The drainage hole 345 may be closed by an auxiliary cap (not shown).

In the meanwhile, when the drainage pump 300 is driven at a high speed in the above structure of the drainage chamber 328, a pressure inside the drainage chamber 328 may be varied by the rotation of the impeller 341. In other words, the pressure of the portion inside the drainage chamber 328 where the wash water is drained may be increased by the impeller 341 and the pressure of the portion where the wash water is drawn may be decreased by the suction of the impeller 341.

Here, when the pressure is decreased by the suction of the impeller 341, vapors might be generated in the wash water by the lowering pressure. The vapor generated in the drainage chamber 328 might affect the operation of the impeller 341, only to result in poor water drainage and noise generated by the vapors during the rotation of the impeller 341.

In the meanwhile, a partition wall 326 is located between the wash water staying space 324 and the drainage chamber 328 to partition off a predetermined space into the wash water staying space 234 and the drainage chamber 328. The partition wall 326 includes a through hole 327 to allow the wash water staying space 324 to communicate with the drainage chamber 328, rather than the drainage path 325.

When the pressure inside the drainage chamber 328 is decreased by the rotation of the impeller 341, the through hole 327 draws the wash water inside the wash water staying space 324 into the drainage chamber 328 to prevent the pressure inside the drainage chamber 328 from decreasing. Because of that, the pressure inside the drainage chamber 328 is decreased by the rotation of the impeller 341 and the smooth driving of the pump may be maintained.

Meanwhile, the second treating part 20*a* of the laundry apparatus 1 described above is movably supported by the supporting device 500. In this case, the second tub 200 is moved by a shock generated by the movement of the laundry apparatus 1 and it might collide with the inside of the drawer 100 to cause damage and breakage thereof. As a result, a fixing material configured to prevent the movement of the second tub 200 when the laundry apparatus 1 is moved is required.

Figure 30:
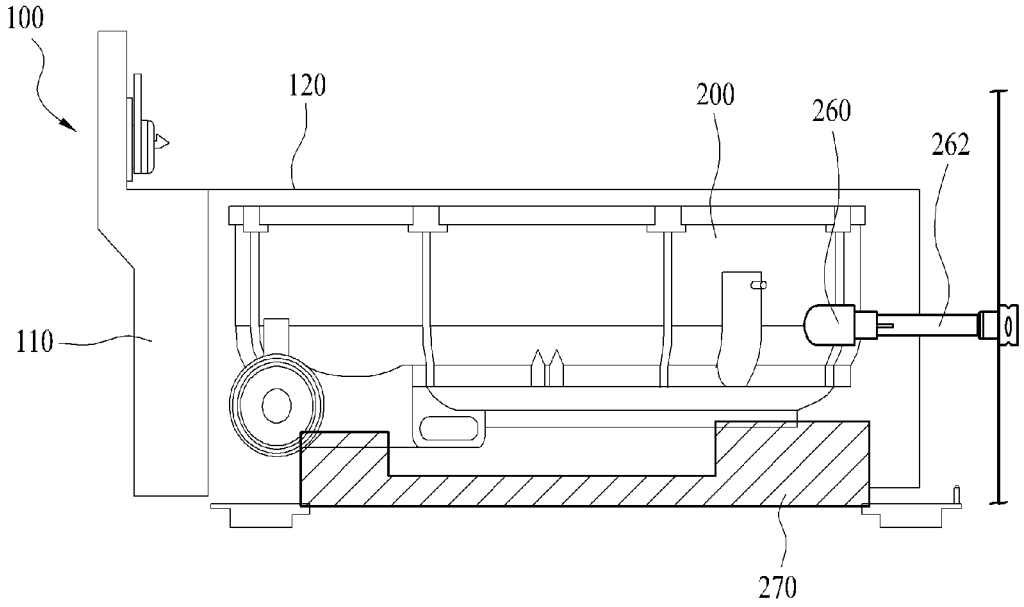
FIG. 30 is a side sectional view illustrating a fixing state of the second tub provided in the laundry apparatus.

As shown in FIG. 30, a transit bolt securing part 260 for securing the vibration of the second tub 200 when the laundry apparatus 1 is moved may be further formed in a predetermined portion of an outer circumferential surface of the second tub 200. It is preferable that the transit bolt securing part 260 is formed in a rear portion of the second tub 200. When the laundry apparatus 1 is moved, a transit bolt 262 passing through the second cabinet 20 is secured to the transit bolt securing part 260 formed in the rear portion of the second tub 200, to prevent vibration of the second tub 200.

Alternatively, a transit bolt 262 passing through the drawer 100 and the second cabinet 20 is secured to the transit securing part 260. In this case, vibration of the second tub 200 is prevented by the transit bolt 262 secured via the drawer 100 and vibration of the second cabinet 20 and the drawer 100 are prevented from being open from the second cabinet 20, when the laundry apparatus 1 is moved.

Moreover, the securing process of the second tub 200 secured by the transit bolt 262 as mentioned above may prevent the horizontal vibration of the second tub 200. However, the horizontal and vertical vibration might be generated complicatedly, when the laundry apparatus 1 is moved. Because of that, it is necessary to prevent the vertical vibration of the second tub 200. The bottoms of the second cabinet 10 and the drawer 100 are open and an auxiliary vibration preventing material 270 is inserted in the open bottoms of the second cabinet 20 and the drawer 100, to prevent the vertical vibration of the second tub 200.

The auxiliary vibration preventing material 270 is formed of a predetermined material such as Styrofoam having a shape corresponding to the shape of space located between the second tub 200 and the drawer. The auxiliary vibration preventing material 270 is inserted into the drawer 100 from the bottom of the second cabinet 20, to fix the second tub 200. As a result, the vibration of the second tub 200 may be prevented by the transit bolt 262 and the auxiliary vibration preventing material 270 mentioned above, when the laundry apparatus 1 is moved.

Meanwhile, when the drum is rotated, a balancer used to reduce eccentricity of the drum may be provided. However, the second cabinet 20 provided in the laundry apparatus according to some embodiments may have a smaller washing capacity, that is, at least one of a smaller volume and a smaller height than the first cabinet 20. In case of providing a balancer at the second drum 600, the space for installing the balancer makes the capacity of the second drum 600 smaller or the installation space of the balancer itself may be insufficient.

As a result, in case a ball balancer is provided in the second drum 600 of the second cabinet 20, the present invention provides a balancer capable of reducing an installation space. For that, the balancer according to an embodiment may be employed as at least a part of an outer wall of the drum 600.

If the balancer is provided in the drum like the conventional laundry apparatus, a part of the volume inside the drum is used as an installation space for the balancer and the drum capacity decrease cannot be avoided. In contrast, if the balancer is provided outside the drum, the internal space of the second cabinet 20 is narrow and it is difficult to secure an enough space with the tub.

As a result, an outer wall of the balancer may be used as a part of an outer wall of the second drum 600, not to reduce the capacity of the second drum 600 and to secure the installation space for the balancer. As follows, the balancer will be described in detail in reference to the accompanying drawings.

Figure 31:
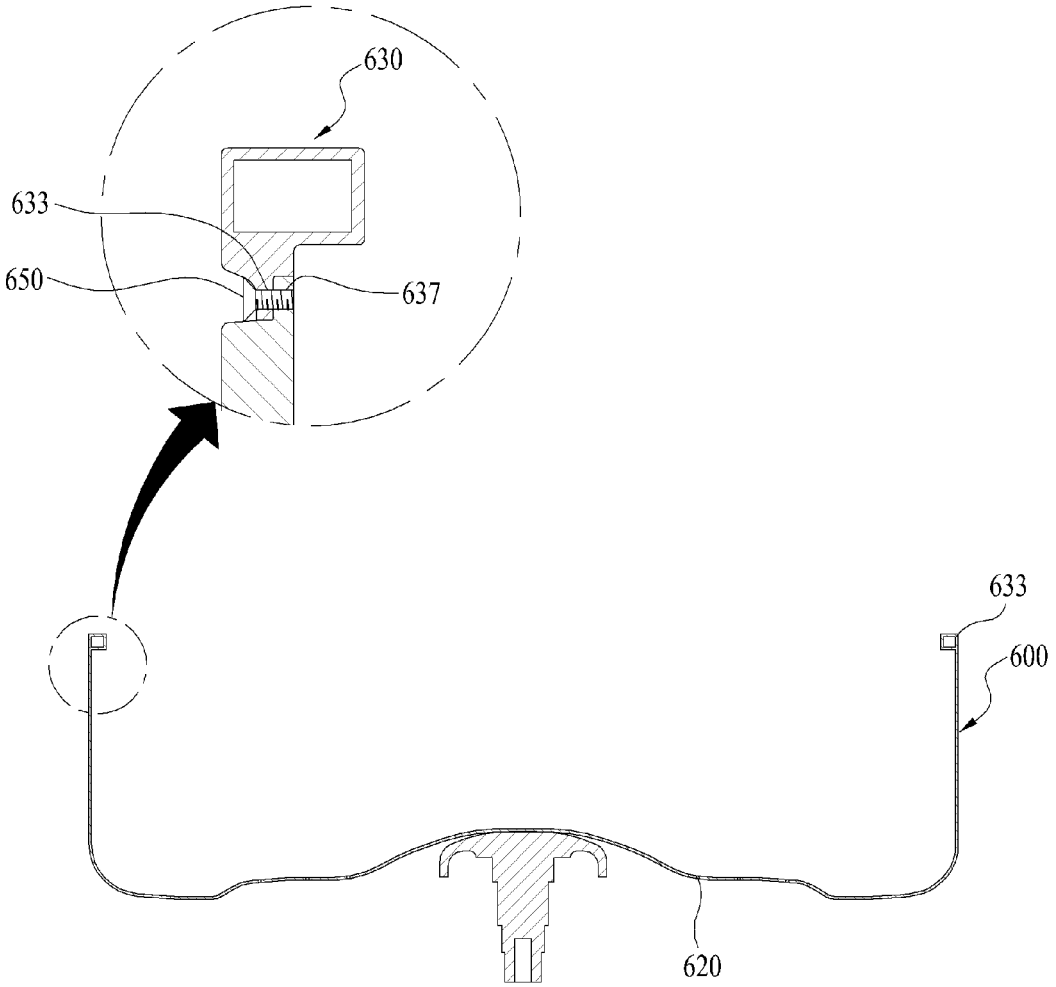
FIG. 31 is a sectional view illustrating a second drum of the laundry apparatus.
Figure 32:
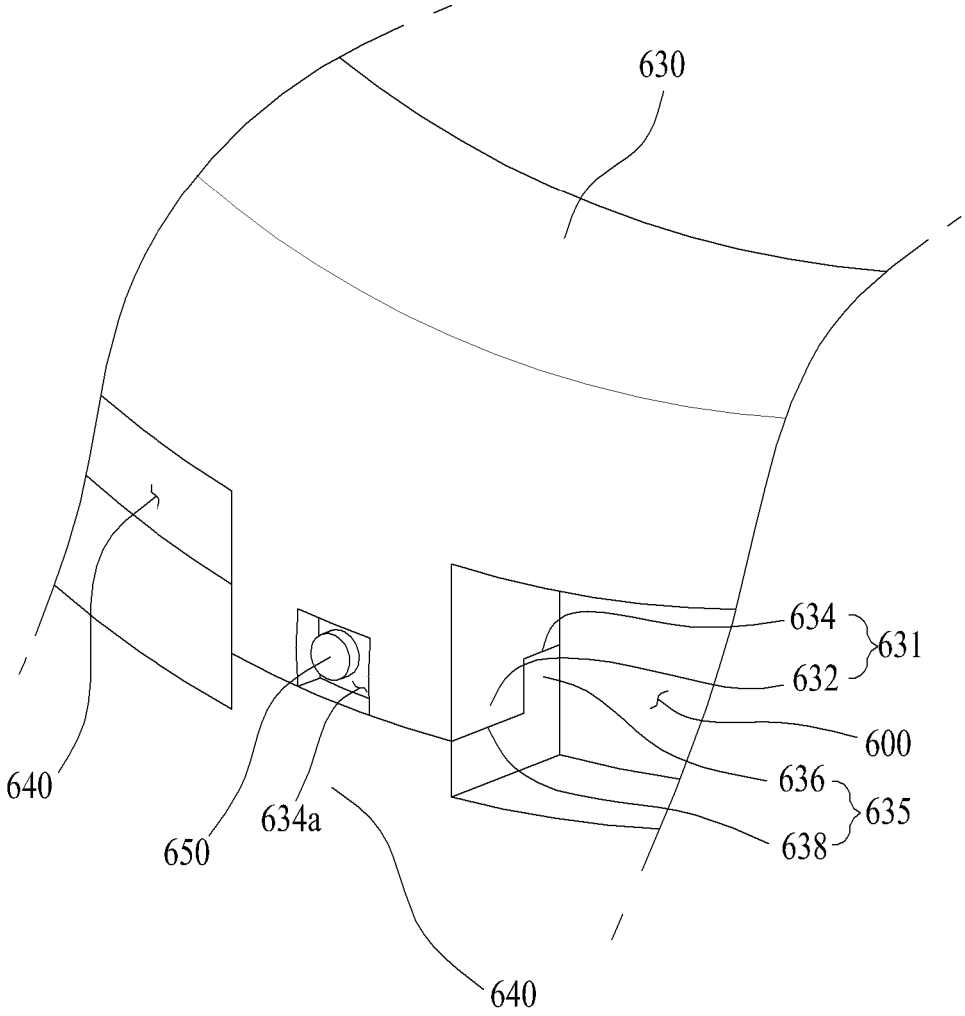
FIG. 32 is a perspective view illustrating a side wall of the second drum provided in the laundry apparatus.

In reference to FIGS. 31 and 32, a balancer 630 according to an embodiment is provided at a top of the drum 600 to be substantially employed as a predetermined portion of a wall of the second drum 600. In other words, the balancer 630 is provided at the top of the drum 600. It can be expected that the top of the drum second drum 600 is extended as much as the height of the balancer 630. For that, the balancer 630 may be projected from the top of the second drum 600 a predetermined distance. In other words, the balancer 630 according to some embodiments may be projected from a top end of the second drum 600, rather than provided inside or outside the second drum 600.

In this case, as shown in FIG. 31, an outer circumferential surface of the balancer 630 may be substantially continuous from an outer circumferential surface of the second drum 600. The outer circumferential surface of the balancer 630 may be provided along the same surface which is identical to the outer circumferential surface of the second drum 600, that is, a predetermined virtual surface. If the balancer 630 is projected outwardly from the second drum 600, the internal space of the second cabinet 20 is narrow and interference between the balancer 630 and the second tub 200 might be generated during rotation of the second drum 600, to cause an error. Since the balancer 630 according to some embodiments forms at least a part of the wall of the second drum 600, the balancer 630 may minimize the capacity decrease of the second drum 600.

The connection between the balancer 630 and the second drum 600 will be described as follows. For example, at least one first connecting portion 631 is provided in a bottom of the balancer 630 and at least one second connecting portion 635 corresponding to the first connecting portion 631 may be provided in the top of the second drum 600. Here, the first connecting portion 631 may include a first extended portion 632 extending from the bottom of the balancer 630 downwardly and a first seating portion 643. The second connecting portion 635 includes a second extended portion 636 extending from the top of the second drum 600 upwardly and a second seating portion 638. The first and second extended portions 632 and 636 may include first and second connecting holes 633 and 637, respectively.

When the balancer 630 is connected with the second drum 600, the first extended portion 632 of the balancer 630 may be seated on the second seating portion 638 of the second drum 600 and the second extended portion 636 of the second drum 600 may be seated on the first seating portion 634 of the balancer 630. In other words, when the first and second extended portions 632 and 636 are seated on the second and first seating portions 638 and 634, respectively, the first connecting hole 633 is in communication with the second connecting hole 637. Because of that, a fastening material passing through the first and second connecting holes 633 and 637 may be fastened to connect the balancer 630 to the second drum 600.

In the meanwhile, if the fastening material 650 is projected toward the outside of the second drum 600, interference with the second tub 200 might be generated during the rotation of the second drum 600. Because of that, a concave portion 634*a* may be provided to prevent the fastening material 650 from being projected toward the outside of the second drum 600. The concave portion 634*a* may be provided between the first connecting portion 631 and the second connecting portion 635. When it is fastened, the fastening material 650 is inserted in the concave portion 643*a* and it is prevented from being projected toward the outside of the second drum 600.

The second cabinet 20 of the laundry apparatus 1 according to an embodiment may have at least one of a smaller volume and a smaller height than the first cabinet 10. The height of the second drum 600 may be smaller than that of the first drum. In some embodiments, the balancer 630 is provided on the top of the second drum 600, the height of the second drum 600 may be smaller than a diameter of the second drum 600. In other words, the balancer 630 forms a predetermined part of the outer wall of the second drum 600 and the height of the second drum 600 itself may be smaller accordingly. As a result, the height of the second drum 600 may be smaller than the diameter of the second drum 600.

When the height of the second drum 600 is smaller as mentioned above, compared with that of the conventional drum, it could be difficult to manufacture the second drum 600 according to a conventional method. In other words, a plate type side wall is rolled to be circular and the conventional drum is formed. A base is manufacture independently and the base is connected with the side wall. The height of the second drum 600 according to this embodiment is smaller than that of the conventional drum. The second drum 600 may not be properly manufactured if a side wall and a base are independent and then connect with each other to form the drum. Because of that, to manufacture the second drum 600 of the laundry apparatus according to some embodiments, a single metal sheet is provided and the single metal sheet is used to manufacture the second drum 600 via a drawing process. This is because the height of the second drum 600 is relatively smaller. It is possible to manufacture the second drum 600 in the drawing process and it is further possible to manufacture the second drum 600 according to the embodiment in a single drawing process. As a result, a side wall and a base may be integrally formed as one body to be the second drum 600 according to the embodiment.

The conventional drum provided in the laundry apparatus includes a plurality of drainage holes formed in the side wall thereof to drain water inside the drum. When the drum is rotated, the water inside the drum is drained toward the tub to perform washing and rinsing more smoothly. To form the plurality of the drainage holes, the drum is punched from the inside toward the outside.

However, the second drum 600 according to one embodiment may be integrally manufactured as one body via the drawing process, with a reduced height. If the side wall of the second drum 600 is punched to form drainage holes, portions near the drainage holes might be distorted. In a severe case, a circular profile of the second drum might be distorted during punching of the side wall to form drainage holes. If the profile of the second drum is not uniformly even, the distance with the tub may not be uniform when the drum is rotated, which may cause an error.

To solve this potential problem, the second drum 600 according to some embodiments may not include drainage holes formed along the side wall. Rather, the second drum 600 may include only a drainage hole formed in a drum base 620. When the drum base 620 of the second drum 600 is rotated, the distance with the tub 200 is not so fatal, compared with the side wall, and it is possible to form the drainage hole in the drum base 620.

However, when only the drum base 620 includes the drainage hole, water inside the second drum 600 might leak outside via the top of the second drum 600 by a centrifugal force during the rotation of the second drum 600 and the water might leak outside the second tub 200 according to the rotational speed of the second drum 600.

As a result, auxiliary means for drain the water inside the second drum 600 may be further provided in the side wall to circulate the water via the space with the second tub 200.

For example, according to an embodiment, an opening 640 is provided between the second drum 600 and the balancer 630 to drain the water inside the second drum toward the second tub 200 during the rotation of the second drum 600. In other words, as shown in FIG. 32, the balancer 630 and the second drum 600 may be connected via the first and second connecting portions 631 and 635. The opening 640 may be provided between the first and second connecting portions 631 and 635. When the water is lifted toward an inner wall of the second drum 600 by the centrifugal force, the water inside the second drum 600 may be drained to a predetermined space formed between the second tub 200 and the second drum 600 via the opening 640. The drained water may be stored in the space formed between the second tub 200 and the second drum 600 or it may be re-supplied to the inside of the second drum 600 via the drainage hole provided in the drum base 620 of the second drum 600.

Meanwhile, the drum integrally manufactured as one body in the drawing process may have a deterioration in strength in comparison with a drum manufactured in a conventional process. Also, the internal volume of the second cabinet 20 is narrow and the volume, that is, the washing capacity of the second tub 200 provided in the second cabinet may be decrease. The second drum 600 according to this embodiment includes a structure capable of solving these disadvantages, which will be described as follows.

Figure 33:
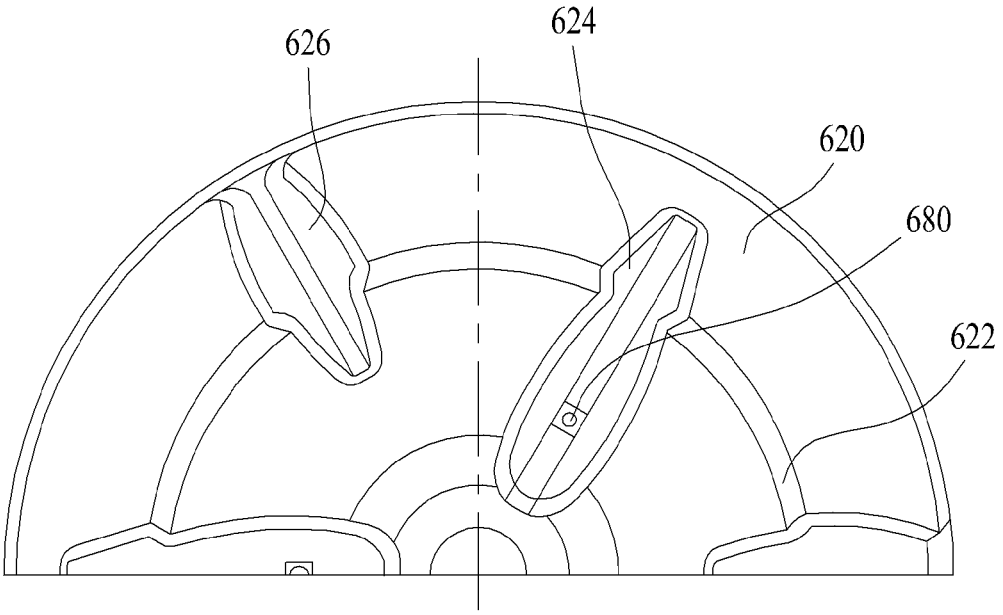
FIG. 33 is a plane view illustrating a base of the second drum provided in the laundry apparatus.
Figure 34:
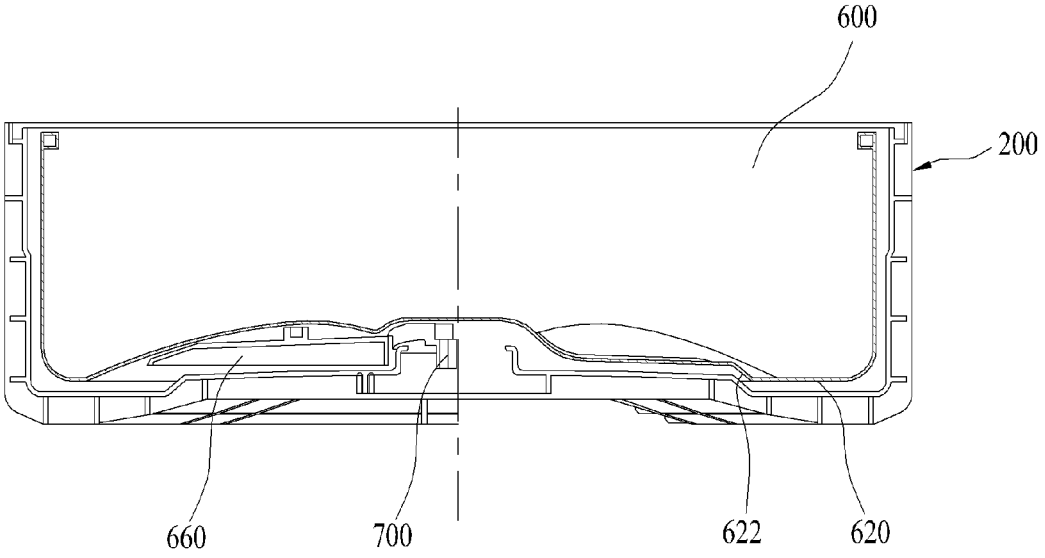
FIG. 34 is a side sectional view illustrating the base of the second drum.
Figure 35:
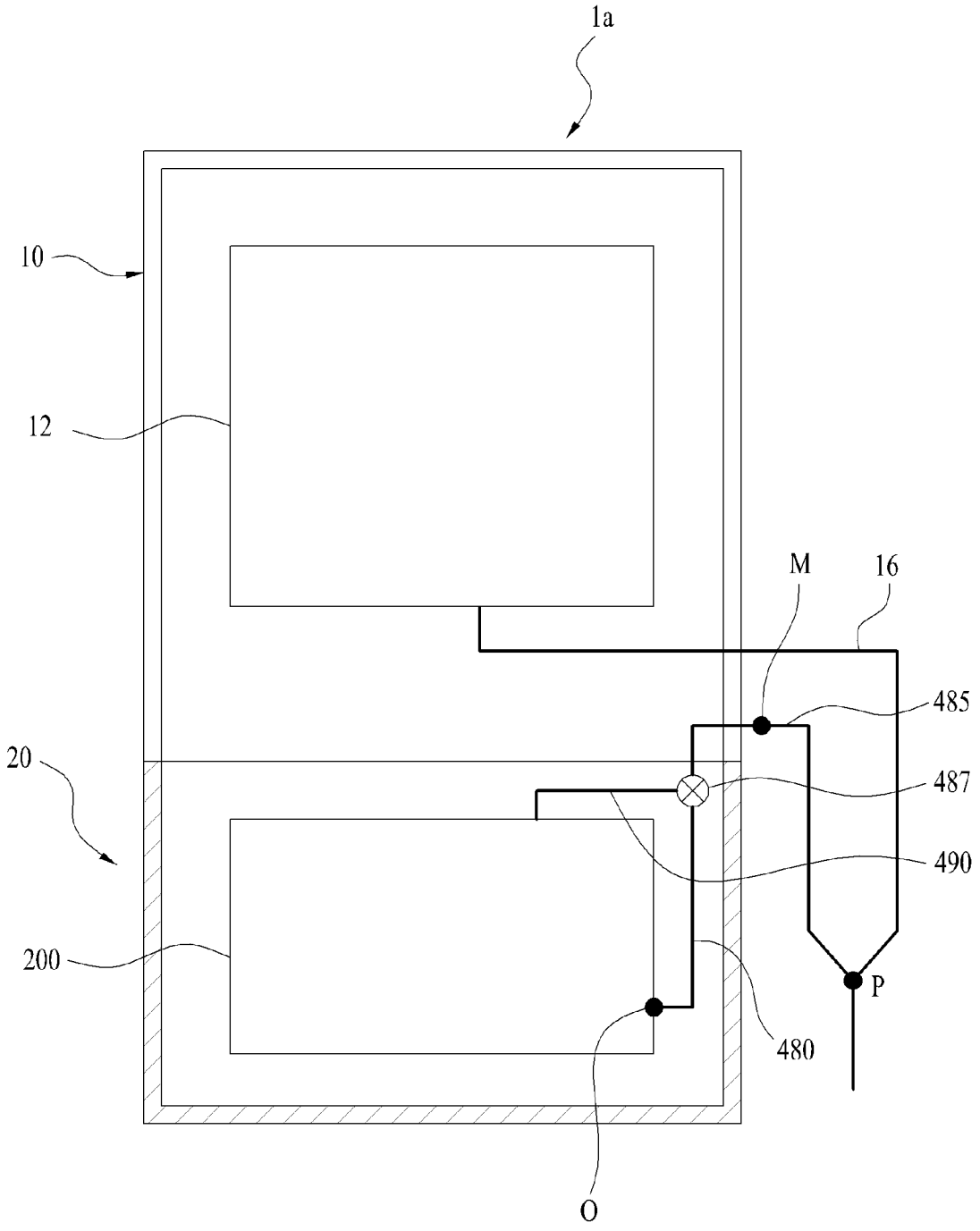
FIG. 35 is a conceptual diagram illustrating a drainage structure of the laundry apparatus.

In reference to FIGS. 33 and 34, the second drum 600 according to some embodiments may reinforce the strength of the drum itself and it may include a stepped portion 622 provided in the drum base 620 to enhance the washing capacity of the second drum 600. Here, the stepped portion 622 may be provided to make an outer portion of the drum base 620 lower than a center thereof. The stepped portion 622 is provided to reinforce the strength of the second drum 600 and to make the second drum 600 getting lower as coming toward the outer portion. Because of that, the internal volume of the second drum 600 may be increased.

Moreover, to reinforce the strength of the second drum 600, the second drum 600 according to this embodiment includes a first convex portion 624 extending towards the center of the drum base 620 from an outer portion of the drum base 620. For example, at least one convex portion 624 may be provided and the at least one convex portion 624 may be extended toward the center from the outer portion of the drum base 620. In this case, the first convex portion 624, extending toward the center of the drum base 620, may be connected with the stepped portion 622 of the drum base 620. As a result, the strength of the second drum according to this embodiment may be reinforced by the stepped portion 622 provided in the drum base 620 and the first convex portion connected with the stepped portion 622.

In the meanwhile, the second drum 600 may be rotatable within the second tub 200. In this case, the second drum 600 may include a connecting portion 660 extended from the shaft 700 to be connected therewith, in communication with the shaft 700, to allow the second drum 600 to be rotatable. The connecting portion 660 may be connected with the second drum 600 by a fastening material (229, see FIG. 33) such as a bolt. The connecting portion 660 extends from the shaft 700 provided in the center of the drum base 620 in a radial direction. A seating portion may be provided in the drum base 620 of the second drum 600 to seat the connecting portion 660 thereon. The seating portion may be created to be a second convex portion 626 extending outwardly from the center of the drum base 620. In other words, the connecting portion 660 may be seated in a lower portion of the second convex portion 626 and it may be connected with the second drum 600 by the fastening material 650.

When the stepped portion 622 if provided in the drum base 620 of the second drum 600 as mentioned above, a stepped portion 221 may be provided in a tub base 220 of the second tub 200 to maintain the predetermined distance with the second drum 600 and to reinforce the strength of the second tub 200. The stepped portion has an outer portion lower than a center portion.

According to the laundry apparatus 1 described above, the balancer 630 forming at least a predetermined part of the wall of the drum may be provided. Because of that, when the second cabinet 20 is provided, the second drum 600 may be installed in the second cabinet 20 having a relatively narrow internal space and the drum capacity decrease may be minimized.

Meanwhile, drainage of the wash water may be performed in the first treating part 10*a* located beyond the second treating part and the second treating parts 20*a*. At this time, the wash water drained from the first treating part 10*a* might flow backward to the second treating part 20*a*. It is required to improve the drainage structure of the first and second treating parts 10*a* and 20*a*.

As follows, the drainage structure of the first and second treating parts 10*a* and 20*a* provided in the laundry apparatus 1 according to embodiments of the present invention will be describe in detail in reference to the accompanying drawings.

As shown in FIG. 13, a first drainage pipe 16 is provided in the first treating part 10*a* to drain the wash water used in the first treating part 10*a*. The first drainage pipe 16 is in communication with the first tub of the first treating part 10*a*. A second drainage pipe 480 is provided in the second treating part 20*a* to drain the wash water used in the second treating part 20*a*. The second drainage pipe 480 is in communication with the second tub 200. The first drainage pipe 16 of the first treating part 10*a* and the second drainage pipe 480 of the second treating part 20*a* may be integrated outside the cabinet 1*a*. A junction pipe 485 is provided at a junction point (P) and the junction pipe 485 is arranged in a "U" shape, to prevent the drained wash water from flowing backward.

Together with that, the second drainage pipe 480 of the second treating part 20*a* is upward with respect to the ground for a predetermined period and downward again to be integrated with the first drainage pipe 16 of the first treating par t10*a*. The second drainage pipe 480 has an outlet point (O) led out from the bottom of the second tub 200, a maximum point (M) of the highest position with respect to the ground and a junction point (P) integrated with the first drainage pipe 16 of the first treating part 10*a*.

Here, the outlet point (O) and the junction point (P) are located higher than the maximum point (M). In other words, the maximum point (M) is located higher than the outlet point (O) and the junction point (P). As a result, the wash water of the junction point (P) may be prevented from flow backward into the second tub 200 against the drainage direction.

When the laundry is washed by using the second treating part 20*a*, too many bubbles might be generated in the second tub 200. When too many bubbles are generated in the second tub 200, a friction may be generated by the bubbles located between the second drum 600 and the second tub 200. The friction interferes with efficient rotation of the second drum 600.

Because of that, the second treating part 20*a* may include a bubble outlet pipe 490 to discharge the bubbles generated in the second tub 200. An end of the bubble outlet pipe 490 is coupled to a predetermined portion of the top of the second tub 200 and the other end is connected with the second drainage pipe 480. Preferably, the end of the bubble outlet pipe 490 is coupled to a top surface of the top cover 210 of the second tub 200.

In addition, a check valve 487 may be provided at a connected point between the bubble outlet pipe 490 and the second drainage pipe 480. The check valve 487 may be selectively closed according to a case of discharging bubbles or a case of discharging wash water.

In the meanwhile, the bubble outlet pipe 490 may be used to discharge too much steam generated in the second tub

200. The feature used to discharge the too much steam generated in the second tub 200 is the same as the feature used to discharge the bubbles and detailed description thereof will be omitted accordingly.

It will be apparent to those skilled in the art that various modifications and variations can be made in embodiments of the present invention without departing from the spirit or scope of the inventions. Thus, it is intended that embodiments of the present invention cover the modifications and variations of embodiments of this invention provided they come within the scope of the appended claims and their equivalents.

What is claimed is:

1. A laundry apparatus comprising:
a cabinet;
a drawer comprising:
a housing that is configured to be forwardly extracted from and retracted into the cabinet; and
a front portion mounted on the housing to form a front surface of the drawer;
a tub provided in the housing to store water;
a drum rotatably provided in the tub to store laundry;
a pump part configured to drain the water in the tub; and
a filter part configured to filter the water discharged from the tub by the pump part,
wherein the filter part is detachable from the housing and is configured to be exposed to the outside of the cabinet when the drawer is extracted.

2. The laundry apparatus according to claim 1, wherein the filter part is detachable from an upper surface of the housing.

3. The laundry apparatus according to claim 1, wherein the filter part is provided in a front corner an upper surface of the housing.

4. The laundry apparatus according to claim 1, wherein the filter part is detachable from a side surface of the housing.

5. The laundry apparatus according to claim 1, wherein the pump part comprises:
a filter coupling part communicating with the tub and configured to couple the filter part thereto detachably;
a drainage chamber in communication with the filter coupling part;
a rotatable impeller provided in the drainage chamber; and
a drainage pipe to guide water discharged from the drainage chamber to the outside of the cabinet.

6. The laundry apparatus according to claim 5, further comprising:
a first surface provided in the filter part to form a part of the filter part and make a cross section of the filter part asymmetry; and
a second surface provided in the filter coupling part,
wherein the second surface forms a part of an inner surface of the filter coupling part and corresponds to the first surface.

7. The laundry apparatus according to claim 5, further comprising:
a drainage hole that drains the water remained in the drainage chamber.

8. The laundry apparatus according to claim 7, wherein the drainage hole is provided in a position exposable to the outside of the cabinet when the drawer is extracted.

9. The laundry apparatus according to claim 5, further comprising:
a first link rotatably connected to a rear surface of the cabinet; and
a second link having one end rotatably connected to a rear surface of the drawer and the other end rotatably connected to the first link,
wherein the drainage pipe is supported by both the first link and second link.

10. The laundry apparatus according to claim 9, wherein the first link and the second link are configured to rotate in a plane parallel to a bottom surface of the cabinet when the drawer is extracted from or retracted into the cabinet.

11. The laundry apparatus according to claim 10, wherein the first and second link are arranged in parallel to a width direction of the cabinet.

12. A laundry apparatus comprising:
a cabinet;
a drawer comprising:
a housing that is configured to be forwardly extracted from and retracted into the cabinet; and
a front portion mounted on the housing to form a front surface of the drawer;
a tub provided in the housing to store water;
a drum rotatably provided in the tub to store laundry;
a pump part configured to drain the water in the tub; and
a filter part configured to filter the water discharged from the tub by the pump part,
wherein the filter part is detachable from the front portion and is configured to be exposed to the outside of the cabinet when the drawer is extracted.

* * * * *